US007004651B2

(12) United States Patent
Tanaka et al.

(10) Patent No.: US 7,004,651 B2
(45) Date of Patent: Feb. 28, 2006

(54) SUBMERGED PROCESSING DEVICE FOR PHOTOSENSITIVE MATERIAL

(75) Inventors: Katsuhiko Tanaka, Kanagawa (JP); Fumio Mogi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/807,394

(22) Filed: Mar. 24, 2004

(65) Prior Publication Data

US 2004/0190893 A1 Sep. 30, 2004

(30) Foreign Application Priority Data

Mar. 25, 2003 (JP) ..... 2003-083074

(51) Int. Cl.
*G03D 3/08* (2006.01)

(52) U.S. Cl. ..... 396/617; 396/620; 396/626; 396/636; 355/27; 430/30; 430/399

(58) Field of Classification Search ..... 396/617, 396/620, 626, 636
See application file for complete search history.

(56) References Cited

U.S. PATENT DOCUMENTS 5,168,296 A * 12/1992 Nakamura et al. ..... 396/620
5,379,087 A * 1/1995 Devaney et al. ..... 396/636
6,071,020 A * 6/2000 Verlinden et al. ..... 396/612
6,513,539 B1 2/2003 Tanaka
6,652,168 B1 * 11/2003 Hyodo ..... 396/620

FOREIGN PATENT DOCUMENTS

JP 2002-55422 A 2/2002

* cited by examiner

*Primary Examiner*—D. Rutledge
(74) *Attorney, Agent, or Firm*—Sughrue Mion, PLLC

(57) ABSTRACT

A submerged processing device for a photosensitive material disposed at a partitioning wall which is provided within a processing tank main body and which is between processing chambers respectively storing a processing liquid, the submerged processing device includes: a housing at an interior of which is formed a processing space where the processing liquid is stored; a conveying path for conveying-in of the photosensitive material and which is formed in the housing so as to communicate with an interior of the processing space; a path for conveying-out of the photosensitive material and which is formed in the housing so as to communicate with the interior of the processing space; a processing liquid passage preventing mechanism disposed at the photosensitive material conveying path such that only the photosensitive material passes therethrough; and a processing liquid changing mechanism provided at the housing, for changing the processing liquid stored in the processing space.

18 Claims, 17 Drawing Sheets

SUBMERGED PROCESSING DEVICE FOR PHOTOSENSITIVE MATERIAL

CROSS-REFERENCE TO RELATED APPLICATION

This application claims priority under 35 USC 119 from Japanese Patent Application No. 2003-083074, the disclosure of which is incorporated by reference herein.

BACKGROUND OF THE INVENTION

1. Field of the Invention

The present invention relates to a submerged processing device for a photosensitive material which is mounted such that a processing chamber is set on a conveying path along which a photosensitive material is conveyed in a liquid (solution) within a processing tank.

2. Description of the Related Art

Photosensitive material processing devices (e.g., automatic developing devices such as film processors, printer processors, and the like) which develop photosensitive materials (e.g., films and color papers) are generally used. Such a photosensitive material processing device has a processing tank containing a developing liquid, a processing tank containing a bleaching and fixing liquid, and a processing tank containing a washing and stabilizing processing liquid. Developing processing is carried out by an exposed photosensitive material being immersed in the developing liquid, the bleaching and fixing liquid, and the washing and stabilizing processing liquid while being conveyed.

Among conventional photosensitive material processing devices, those provided with a submerged conveying structure have been proposed (see, for example, Japanese Patent Application Laid-Open (JP-A) No. 2002-55422). In this photosensitive material processing device provided with a submerged conveying structure, a plurality of processing chambers are provided in the washing tank and the like. The processing chambers are partitioned in order to prevent liquid from leaking from a previous bath into a next bath, by a submerged seal formed by rollers or a blade or the like. The photosensitive material is conveyed so as to successively pass through the respective processing chambers, and contacts the processing liquids (processing solutions) in the respective processing chambers so as to be processed.

In a conventional photosensitive material processing device such as that described above, conveying rollers must be disposed at positions immediately before and immediately after the respective submerged seals between the plural processing chambers. Therefore, when looking at the overall conveying path, there are many conveying rollers, the conveying path is long, and it is difficult to make processing of the photosensitive material more rapid.

When there is a large number of conveying rollers, the number of parts increases correspondingly, and the manufacturing cost of the processing device increases.

In addition, in a processing tank which is made large in order to set therein a long conveying path having many conveying rollers, the efficiency of stirring the processing liquid which is stored therein is poor. Therefore, the processing liquid must be stirred by using a relatively large stirring pump.

Moreover, in the conventional submerged seal structure utilizing blades which partition the respective processing chambers, when a photosensitive material having a relatively strong curl passes by the blade, problems arise in that the blade is pushed up and a large amount of liquid leaks from the previous bath into the next bath, and in that the squeezing performance is poor.

SUMMARY OF THE INVENTION

In view of the aforementioned, an object of the present invention is to provide a submerged processing device for a photosensitive material which, by improving the efficiency and the performance of processing a photosensitive material by a liquid so as to promote the processing by the liquid, shortens the conveying path and increases the speed of processing, and which can maintain a good squeezing performance even if the photosensitive material is curled.

A first aspect of the present invention is to provide a submerged processing device for a photosensitive material, the submerged processing device being disposed at a partitioning wall which is provided within a processing tank main body and which is between processing chambers respectively storing a processing liquid, the submerged processing device comprising: a housing at an interior of which is formed a processing space in which the processing liquid is stored; a photosensitive material conveying path which is for conveying-in of the photosensitive material and which is formed in the housing so as to communicate with an interior of the processing space; a photosensitive material conveying path which is for conveying-out of the photosensitive material and which is formed in the housing so as to communicate with the interior of the processing space; a processing liquid passage preventing mechanism disposed at each of the photosensitive material conveying paths such that only the photosensitive material passes therethrough; and a processing liquid changing mechanism provided at the housing, for changing the processing liquid stored in the processing space.

In accordance with the above-described structure, when the photosensitive material passes through the submerged processing device for a photosensitive material which is at the partitioning wall of one processing chamber and is conveyed to another processing chamber, the photosensitive material is subjected to liquid processing by the processing liquid stored in the processing space in the submerged processing device for a photosensitive material. Accordingly, looking at the processing tank main body overall, the photosensitive material is subjected to liquid processing in the processing liquids respectively stored in the plural processing chambers, and is subjected to liquid processing also by the processing liquids stored in the processing spaces of the submerged processing devices for a photosensitive material. The liquid processing is promoted, and the efficiency of the liquid processing can be improved. Moreover, the efficiency of the liquid processing can be improved without increasing the total number of processing chambers in the processing tank main body overall. Therefore, the processing tank main body can be made to be compact on the whole. In this way, the conveying path of the photosensitive material can be made to be short. In addition, the time required for the liquid processing carried out in the entire processing tank main body can be shortened. Moreover, because the processing tank main body is compact on the whole and the conveying path is shortened, the efficiency of stirring the processing liquid stored therein can be improved. Therefore, the structure can be simplified without the need for stirring the processing liquid by using a stirring pump.

Moreover, in a case in which the submerged processing device for a photosensitive material is used, when the photosensitive material passes through the submerged processing device for a photosensitive material provided at the partitioning wall, and the photosensitive material is conveyed from one processing chamber to another processing chamber, the photosensitive material passes a total of two times through the processing liquid passage preventing mechanisms which are provided at the entrance and the exit, respectively, of the housing of the submerged processing device. Therefore, the processing liquid is sufficiently squeezed-out, and the components are diluted by the processing liquid stored in the processing space in the submerged processing device for a photosensitive material. It is thereby possible to reduce the amount of the liquid that is carried over from a processing chamber located upstream along the conveying path to a processing chamber located downstream along the conveying path.

A second aspect of the present invention is to provide a submerged processing device for a photosensitive material, the submerged processing device being disposed at a partitioning wall which is provided within a processing tank main body and which is between processing chambers respectively storing a processing liquid, the submerged processing device comprising: a housing at an interior of which is formed a processing space in which the processing liquid is stored; a photosensitive material conveying path which is for conveying-in of the photosensitive material and which is formed in the housing so as to communicate with an interior of the processing space; a photosensitive material entrance side driving roller for conveying, disposed in a vicinity of an entrance of the photosensitive material conveying path which is for the conveying-in of the photosensitive material; a photosensitive material conveying path which is for conveying-out of the photosensitive material and which is formed in the housing so as to communicate with the interior of the processing space; a photosensitive material exit side driving roller for conveying, disposed in a vicinity of an exit of the photosensitive material conveying path which is for the conveying-out of the photosensitive material, the photosensitive material exit side driving roller for conveying being a driving roller which is disposed firstly at a conveying direction downstream side of the photosensitive material entrance side driving roller for conveying; a processing liquid passage preventing mechanism disposed at each of the photosensitive material conveying paths such that only the photosensitive material passes therethrough; and a processing liquid changing mechanism provided at the housing, for changing the processing liquid stored in the processing space.

In accordance with the above-described structure, when the photosensitive material passes through the submerged processing device for a photosensitive material which is at the partitioning wall of one processing chamber and is conveyed to another processing chamber, the photosensitive material is subjected to liquid processing by the processing liquid stored in the processing space in the submerged processing device for a photosensitive material. Accordingly, looking at the processing tank main body overall, the photosensitive material is subjected to liquid processing in the processing liquids respectively stored in the plural processing chambers, and is subjected to liquid processing also by the processing liquids stored in the processing spaces of the submerged processing devices for a photosensitive material. The liquid processing is promoted, and the efficiency of the liquid processing can be improved. At the same time, the efficiency of the liquid processing can be improved without increasing the total number of processing chambers in the processing tank main body overall. Therefore, the processing tank main body can be made to be compact on the whole. In this way, the conveying path of the photosensitive material can be made to be short. In addition, the time required for the liquid processing carried out in the entire processing tank main body can be shortened. Moreover, because the processing tank main body is compact on the whole and the conveying path is shortened, the efficiency of stirring the processing liquid stored therein can be improved. Therefore, the structure can be simplified without the need for stirring the processing liquid by using a stirring pump.

Moreover, in a case in which the submerged processing device for a photosensitive material is used, when the photosensitive material passes through the submerged processing device for a photosensitive material provided at the partitioning wall, and the photosensitive material is conveyed from one processing chamber to another processing chamber, the photosensitive material passes a total of two times through the processing liquid passage preventing mechanisms which are provided at the entrance and the exit, respectively, of the housing of the submerged processing device. Therefore, the processing liquid is sufficiently squeezed-out, and the components are diluted by the processing liquid stored in the processing space in the submerged processing device for a photosensitive material. It is thereby possible to reduce the amount of the liquid that is carried over from a processing chamber located upstream along the conveying path to a processing chamber located downstream along the conveying path.

Moreover, in this submerged processing device for a photosensitive material, the interval between the photosensitive material entrance side driving roller for conveying and the photosensitive material exit side driving roller for conveying is set to be shorter than the shortest photosensitive material, and the overall region over which the photosensitive material can be conveyed is made to be compact. Accordingly, in this submerged processing device for a photosensitive material, the conveying direction length of the processing space provided in the housing can naturally be made to be short. Therefore, the processing liquid stored in the processing space can be stirred merely by the flow of liquid at the time when the photosensitive material passes through. Further, in this submerged processing device for a photosensitive material, because no driving rollers are provided within the processing space of the housing, the number of parts can be made to be few, and the device can be manufactured at a low cost.

A third aspect of the present invention is to provide a submerged processing device for a photosensitive material, the submerged processing device being disposed at a partitioning wall which is provided within a processing tank main body and which is between processing chambers respectively storing a processing liquid, the submerged processing device comprising: a housing at an interior of which is formed a processing space in which the processing liquid is stored; a photosensitive material conveying path which is for conveying-in of the photosensitive material and which is formed in the housing so as to communicate with an interior of the processing space; a photosensitive material entrance side driving roller for conveying, disposed in a vicinity of an entrance of the photosensitive material conveying path which is for the conveying-in of the photosensitive material; a photosensitive material conveying path which is for conveying-out of the photosensitive material and which is formed in the housing so as to communicate with the interior of the processing space; a photosensitive material exit side driving roller for conveying, disposed in a vicinity of an exit of the photosensitive material conveying path which is for the conveying-out of the photosensitive material, the photosensitive material exit side driving roller for conveying being a driving roller which is disposed firstly at a conveying direction downstream side of the photosensitive material entrance side driving roller for conveying; a blade provided so as to close and seal a slit hole forming the photosensitive material conveying path, and squeezing the photosensitive material passing through the slit hole by slidingly-contacting the photosensitive material, and preventing passage of the processing liquid; a liquid flow-in mechanism, mounted to a position of the housing at one longitudinal direction end portion side of the processing space, for causing the processing liquid to flow-in in a direction opposite to a conveying direction of the photosensitive material; and a liquid flow-out mechanism, mounted to a position of the housing at another longitudinal direction end portion side of the processing space, for causing the processing liquid to flow-out in the direction opposite to the conveying direction of the photosensitive material.

In accordance with the above-described structure, when the photosensitive material passes through the submerged processing device for a photosensitive material which is at the partitioning wall of one processing chamber and is conveyed to another processing chamber, the photosensitive material is subjected to liquid processing by the processing liquid stored in the processing space in the submerged processing device for a photosensitive material. Accordingly, looking at the processing tank main body overall, the photosensitive material is subjected to liquid processing in the processing liquids respectively stored in the plural processing chambers, and is subjected to liquid processing also by the processing liquids stored in the processing spaces of the submerged processing devices for a photosensitive material. The liquid processing is promoted, and the efficiency of the liquid processing can be improved. At the same time, the efficiency of the liquid processing can be improved without increasing the total number of processing chambers in the processing tank main body overall. Therefore, the processing tank main body can be made to be compact on the whole. In this way, the conveying path of the photosensitive material can be made to be short. In addition, the time required for the liquid processing carried out in the entire processing tank main body can be shortened. Moreover, because the processing tank main body is compact on the whole and the conveying path is shortened, the efficiency of stirring the processing liquid stored therein can be improved. Therefore, the structure can be simplified without the need for stirring the processing liquid by using a stirring pump.

Moreover, in a case in which the submerged processing device for a photosensitive material is used, when the photosensitive material passes through the submerged processing device for a photosensitive material provided at the partitioning wall, and the photosensitive material is conveyed from one processing chamber to another processing chamber, the photosensitive material passes, a total of two times, the blades which are provided at the entrance and the exit, respectively, of the housing of the submerged processing. Therefore, the processing liquid is sufficiently squeezed-out, and the components are diluted by the processing liquid stored in the processing space in the submerged processing device for a photosensitive material. It is thereby possible to reduce the amount of the liquid that is carried over from a processing chamber located upstream along the conveying path to a processing chamber located downstream along the conveying path.

Moreover, in the submerged processing device for a photosensitive material, the interval between the photosensitive material entrance side driving roller for conveying and the photosensitive material exit side driving roller for conveying is set to be shorter than the shortest photosensitive material, and the overall region over which the photosensitive material can be conveyed is made to be compact. Accordingly, in this submerged processing device for a photosensitive material, the conveying direction length of the processing space provided in the housing can naturally be made to be short. Therefore, the processing liquid stored in the processing space can be stirred merely by the flow of liquid at the time when the photosensitive material passes through. Further, in this submerged processing device for a photosensitive material, because no driving rollers are provided within the processing space of the housing, the number of parts can be made to be few, and the device can be manufactured at a low cost.

The photosensitive material passes through while simultaneously elastically deforming the plural blades. Therefore, even if the photosensitive material is strongly curled, the curling of the photosensitive material is suppressed by the strong, total urging force of the plural blades. Thus, it is possible to prevent the blades from being raised up by the curled photosensitive material such that gaps form, and to prevent the processing liquid from flowing in and out of the processing space, and the squeezing performance can be stabilized.

Moreover, the submerged processing device for a photosensitive material is disposed at a partitioning wall between processing chambers in a counter-current cascade type processing tank. Due to the operation of the liquid flow-in mechanism and the liquid flow-out mechanism, the processing liquid can be made to flow in the direction opposite to the conveying direction of the photosensitive material.

A fourth aspect of the present invention is to provide a submerged processing device for a photosensitive material having a submerged processing chamber, comprising: an entrance closing member provided in processing liquid at an upstream side, and closing a path at an upstream side of the submerged processing device along which path a photosensitive material passes, and permitting entry of the photosensitive material into the submerged processing device by elastically deforming; an exit closing member provided in processing liquid at a downstream side, and closing a path at a downstream side of the submerged processing device along which path the photosensitive material passes, and permitting withdrawal of the photosensitive material from the submerged processing chamber by elastically deforming; and a storing portion formed between the entrance closing member and the exit closing member.

Further, the entrance closing member and the exit closing member may be formed by blades.

In accordance with the above-described submerged processing device for a photosensitive material, a film of liquid is formed between the entrance blade and the exit blade. Therefore, the emulsion surface of the photosensitive material passing through is not scratched. Moreover, because there are no rollers at the liquid storing portion, the ability to stir the processing liquid improves. In addition, because there are few parts, the submerged processing device for a photosensitive material can be manufactured inexpensively.

The photosensitive material passes through while simultaneously elastically deforming a plurality of blades. Therefore, even if the photosensitive material is strongly curled, the curling of the photosensitive material is suppressed by the strong, total urging force of the plural blades. Thus, it is possible to prevent the blades from being raised up by the curled photosensitive material such that gaps form, and to prevent the processing liquid from flowing in and out of the processing space, and the squeezing performance can be stabilized.

The length, in the conveying direction, of the liquid storing portion is shorter than the length of the shortest photosensitive material. Therefore, the processing liquid in the liquid storing portion can be stirred merely by the flow of liquid at the time when the photosensitive material passes through.

In the fourth aspect, a check valve, which makes processing liquid flow through in a direction opposite to a conveying direction of the photosensitive material, is provided at the storing portion.

In accordance with the above-described structure, the submerged processing device for a photosensitive material is disposed within a cascade-type processing tank. Due to the operation of the check valve, the processing liquid can be made to flow in the direction opposite to the conveying direction of the photosensitive material.

A fifth aspect of the present invention is to provide a submerged processing device for a photosensitive material comprising: a processing tank main body storing a processing liquid; at least two pairs of conveying rollers which are for nipping and conveying a photosensitive material, and which are disposed so as to be separated from one another by an interval in a conveying direction within the processing liquid in the processing tank main body; and rollers for sealing disposed between each of the conveying rollers and inner walls of the processing tank main body, and partitioning such that the processing liquid does not flow through, and forming a processing chamber.

The above-described submerged processing device for a photosensitive material has the effect that the number of processing chambers partitioned by the conveying rollers and the rollers for sealing is increased and the processing capacity is improved. Moreover, it is possible to provide an inexpensive manufactured product in which the total number of parts can be reduced by reducing the number of members used for partitioning, the conveying path can be shortened, the processing time can be shortened, the processing efficiency can be improved, and the structure can be simplified and made more compact.

A sixth aspect of the present invention is to provide a submerged processing device for a photosensitive material, comprising: an entrance blade attached to a first main body member structuring a housing; an exit blade attached to a second main body member structuring the housing; and a storing portion structured by the entrance blade, the exit blade and inner walls of the housing, and storing a processing liquid, wherein the entrance blade permits entry of the photosensitive material into the storing portion by elastically deforming, and the exit blade permits withdrawal of the photosensitive material from the storing portion by elastically deforming.

DETAILED DESCRIPTION OF THE INVENTION

A submerged processing device for a photosensitive material relating to an embodiment of the present invention will be described with reference to FIGS. 1 through 16.

Figure 1:
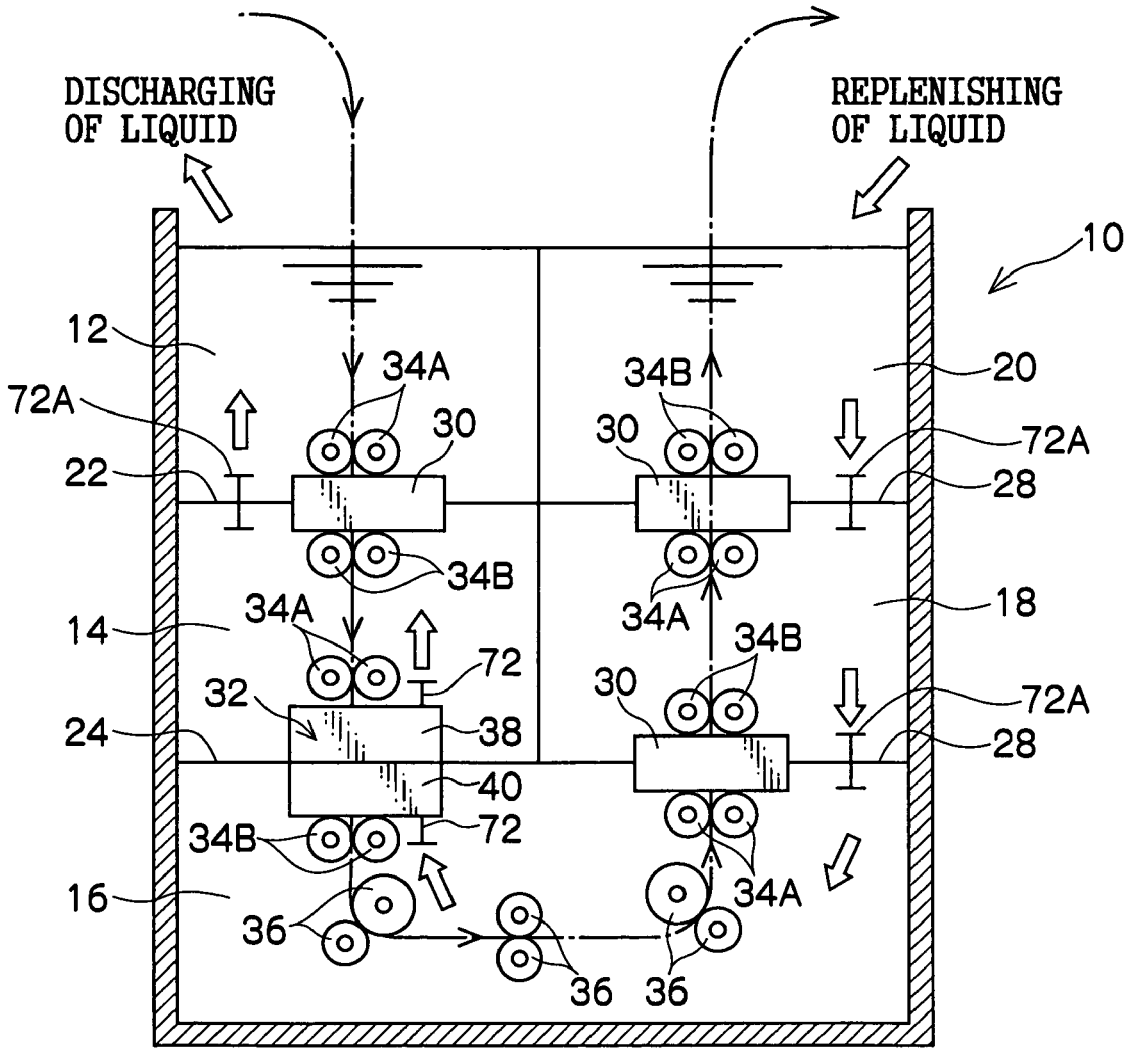
FIG. 1 is a schematic sectional side view showing a processing tank main body having a submerged processing device for a photosensitive material relating to an embodiment of the present invention.

A processing tank main body 10 shown in FIG. 1 is structured as a processing tank which carries out washing and stabilizing processing and which is provided immediately after an unillustrated developing tank and an unillustrated fixing/bleaching tank, at a photosensitive material processing device (automatic developing device) which develops photosensitive materials (e.g., color prints or the like). A predetermined amount of wash water, which serves as a processing liquid (or processing solution), is stored within the processing tank main body 10.

Five processing chambers (processing tanks), which are a first processing chamber 12, a second processing chamber 14, a third processing chamber 16, a fourth processing chamber 18, and a fifth processing chamber 20, are provided so as to be partitioned off from one another in the liquid in the box-shaped processing tank which is the processing tank main body 10.

A conveying path, which is formed by a plurality of conveying rollers 36 (including driving rollers 34A, 34B for conveying) which convey a photosensitive material in a substantial U-shape within the tank through the first processing chamber 12, the second processing chamber 14, the third processing chamber 16, the fourth processing chamber 18, and the fifth processing chamber 20 in this order, is set within the processing tank main body 10.

A submerged conveying device 30 equipped with a squeezing function, which allows passage of a photosensitive material A but prevents processing liquid from flowing through, is provided at each of a partitioning wall 22 between the first processing chamber 12 and the second processing chamber 14, a processing wall 26 between the third processing chamber 16 and the fourth processing chamber 18, and a partitioning wall 28 between the fourth processing chamber 18 and the fifth processing chamber 20.

A submerged conveying/processing device 32 equipped with a squeezing function, which allows passage of the photosensitive material A but prevents processing liquid from flowing through and which processes the photosensitive material in the processing liquid, is provided at a partitioning wall 24 between the second processing chamber 14 and the third processing chamber 16.

The driving rollers 34A for conveying and the driving rollers 34B for conveying are provided at the submerged conveying devices 30 equipped with a squeezing function and the submerged conveying/processing device 32 equipped with a squeezing function. The driving rollers 34A for conveying are nip rollers which serve as a conveying mechanism which conveys the photosensitive material in a vicinity of the entrance at the conveying direction upstream side. The driving rollers 34B for conveying are nip rollers which serve as a conveying mechanism which conveys the photosensitive material in a vicinity of the exit at the conveying direction downstream side. Note that the driving rollers 34A, 34B for conveying, together with the conveying rollers 36, form the conveying path.

Figure 2:
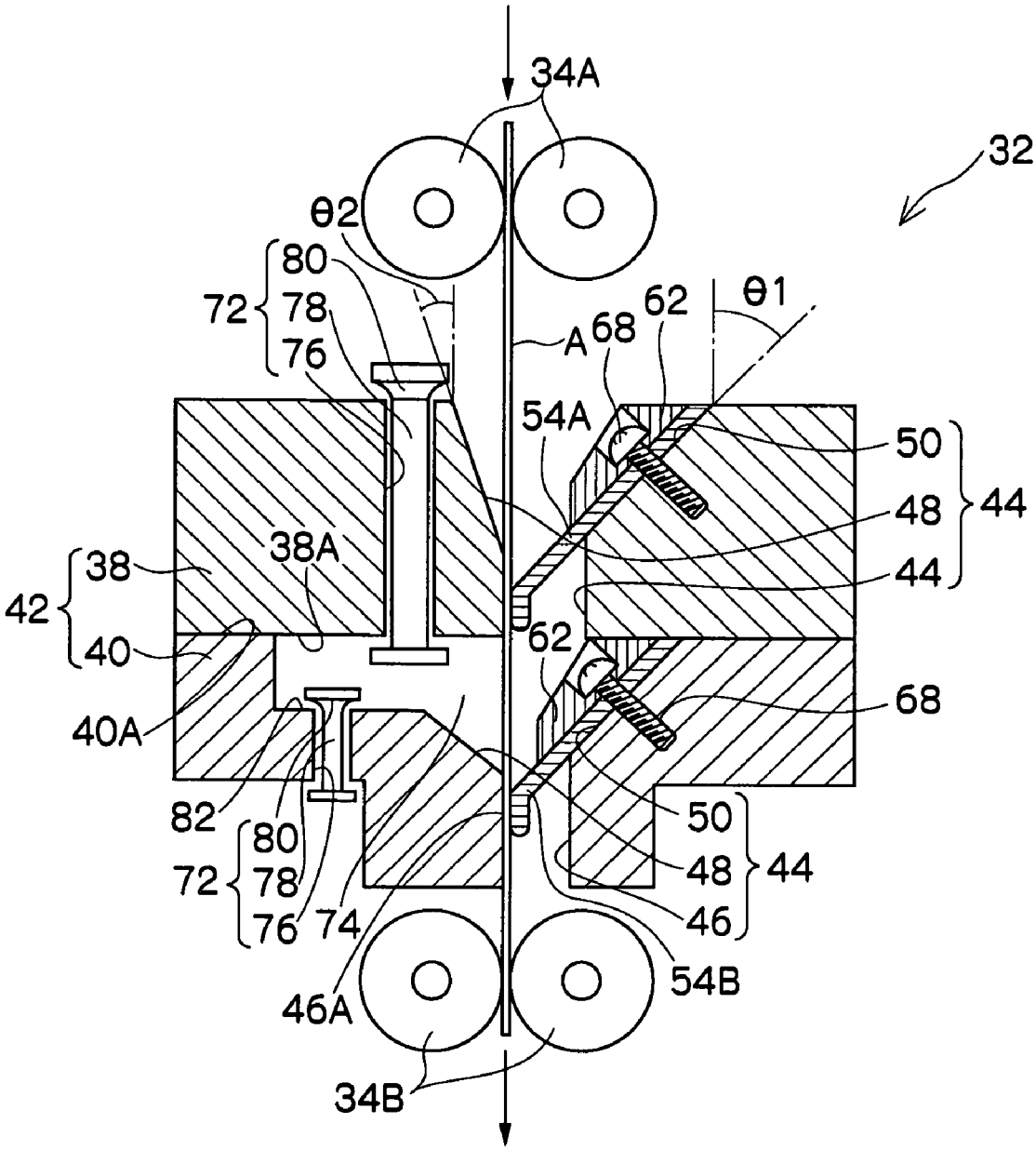
FIG. 2 is a schematic sectional front view showing a submerged conveying/processing device equipped with a squeezing function, which serves as the submerged processing device for a photosensitive material relating to the embodiment of the present invention.

As shown in FIG. 2, at the submerged conveying/processing device 32 equipped with a squeezing function, a housing 42 is formed by a first main body member 38 and a second main body member 40 being combined integrally. Further, as shown in FIG. 1, the housing 42 is disposed so as to be detachably fastened to the opening of the partitioning wall 24.

The first main body member 38 is disposed at the conveying direction upstream side as shown in FIG. 2, and is formed of a synthetic resin (e.g., PC, PPE, ABS, PPS or the like) containing glass fibers. Further, the second main body member 40 is formed of the same material as the first main body member 38: for example, in the present embodiment, a synthetic resin (e.g., PC, PPE, ABS, PPS or the like) containing glass fibers.

A photosensitive material conveying path 44, which permits passage of the photosensitive material, is formed at the first main body member 38 so as to run along the direction in which the photosensitive material is conveyed by the driving rollers 34A for conveying.

The photosensitive material conveying path 44 has a slit 46, an insertion opening guide surface portion 48, and a blade attachment surface portion 50. The slit 46 has a constant width and is formed to be long along the transverse direction of the photosensitive material (the transverse direction of the photosensitive material is a direction orthogonal to the conveying direction thereof). The insertion opening guide surface portion 48 and the blade attachment surface portion 50 open in continuation from the longitudinal direction side surfaces of the slit 46 such that the interval between the mutually opposing side surfaces thereof gradually becomes larger (wider) toward the conveying direction upstream side.

The blade attachment surface portion 50 is inclined at an angle θ'with respect to the plane of conveying of the photosensitive material. The insertion opening guide surface portion 48 is inclined at an angle θ2 with respect to the plane of conveying of the photosensitive material. The angle θ1 and the angle θ2 are preferably within the range of 10° to 80°, and are particularly preferably within the range of 10° to 30°.

Figure 3:
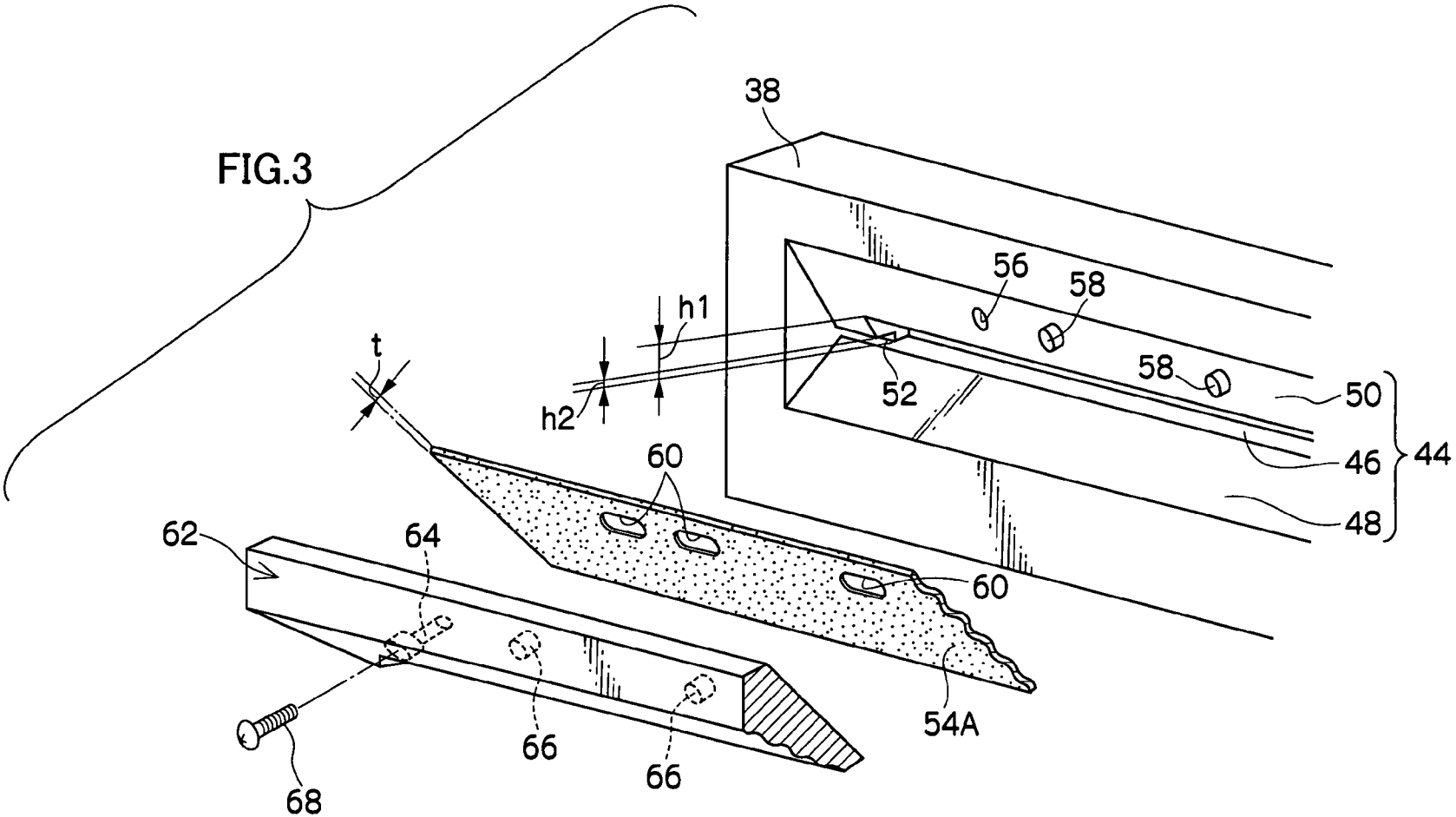
FIG. 3 is an exploded perspective view of main portions showing a first main body member portion in the submerged conveying/processing device equipped with a squeezing function relating to the embodiment of the present invention.

As shown in FIG. 3, grooves 52, which run along the slit 46, are formed in vicinities of the longitudinal direction ends of the photosensitive material conveying path 44, from the portion of the point of intersection of the insertion opening guide surface portion 48 and the blade attachment surface portion 50 toward the conveying direction downstream side.

As shown in FIG. 3, a width h2 of the groove 52 is set to be slightly larger than a thickness t of a blade 54A (as an entrance closing member) which is formed in the shape of a long plate and serves as a processing liquid passage preventing mechanism. (For example, the width h2 is formed to be about 0.01 to 0.5 mm larger than the blade thickness t.) Here, the thickness t of the blade 54A is 0.5 mm, but about 0.3 to 0.7 mm is preferable.

The reason why the width h2 of the groove 52 is set to be slightly larger than the thickness t of the blade 54A is so that, when there is a difference in the change in the dimensions of the blade 54A due to thermal expansion and the change in the dimensions of the first main body member 38 due to thermal expansion, the blade 54A is moved relative to the grooves 52 and no undulations or wrinkles or the like will arise at the blade 54A. Note that the difference between the width h2 of the groove 52 and the thickness t of the blade 54A is preferably made to be as small as possible within a range permitting relative movement of the blade 54A.

As shown in FIG. 3, a plurality of screw holes 56 and a plurality of cylindrical projections 58 are disposed at plural predetermined positions along the longitudinal direction of the blade attachment surface portion 50.

The blade 54A, which is attached to the blade attachment surface portion 50, is formed as a thin-sheet-shaped elastic member which is formed in a rectangular shape of a constant thickness. The blade 54A can be formed of, for example, urethane resin, or may be formed of an elastic material such as rubber or the like. Preferable materials for the material of the blade 54A are as follows.

Polyurethane resins whose Japan Industrial Standards (JIS) A degree of hardness is 80 to 99° are suitable as the material of the blade 54A. In particular, thermosetting polyurethane and materials whose raw material is a polyether prepolymer are suitable as the material for the blade 54A which is to be used over a long time in a liquid.

Trilene diisocyanate (TDI) and TDI prepolymers are suitable as a polyisocyanate raw material. Among polyether prepolymers, in particular, polytetramethylene ether glycol types (PTMG types) are preferable. An aromatic amine compound is used as the curing agent.

Specific examples include Coronate 4080, Coronate 4090, Coronate 4095, Coronate 4099, Coronate 6912, and the like manufactured by Nippon Polyurethane Industry Co., Ltd. These are TDI polyurethanes, and PTMG prepolymers can be used.

Further, Takenate L-2000 series resins, L-2690, L-2695, L-2705, L-2710, L2760 and the like manufactured by Takeda Chemical Industries, Ltd. can be used. These are PTMG polyurethane resins for casting.

Note that the material of the blade 54A is not limited to the aforementioned materials. It is possible to use any of the series of materials called aziprene type prepolymers (PTG (polyether polyols)/TDI type) among the prepolymer casting urethane elastomers on page 117 which are thermosetting urethane elastomers on page 116 of "Latest Applied Polyurethane Technology", published by CMC, Feb. 26, 1983.

The longitudinal direction dimension of the photosensitive material conveying path 44 is set to be slightly larger (e.g., 0.1 to 1.5 mm larger) than the longitudinal direction dimension of the blade 54A.

This is in order to prevent the both end portions of the blade 54A from strongly contacting longitudinal direction side walls of the photosensitive material conveying path 44 and the blade 54A from being strained (undulations or wrinkles or the like arising thereat) when the blade 54A thermally expands, because the coefficient of thermal expansion of the blade 54A is greater than the coefficient of thermal expansion of the first main body member 38.

Elongated holes 60, which are formed to be long along the longitudinal direction of the blade 54A, are formed in positions of the blade 54A which positions correspond to the screw holes 56 and the projections 58 formed at the blade attachment surface portion 50.

The blade 54A, which is structured in this way, is attached to the blade attachment surface portion 50 of the first main body member 38 by a blade pushing member 62.

The blade pushing member 62 is formed of the same material as the first main body member 38, and is formed so as to be substantially triangular in cross-section and so as to be shaped as a long plate as seen in plan view. Note that the longitudinal direction dimension of the blade pushing member 62 is formed to be the same as or slightly smaller than the longitudinal direction dimension of the blade 54A.

Figure 4:
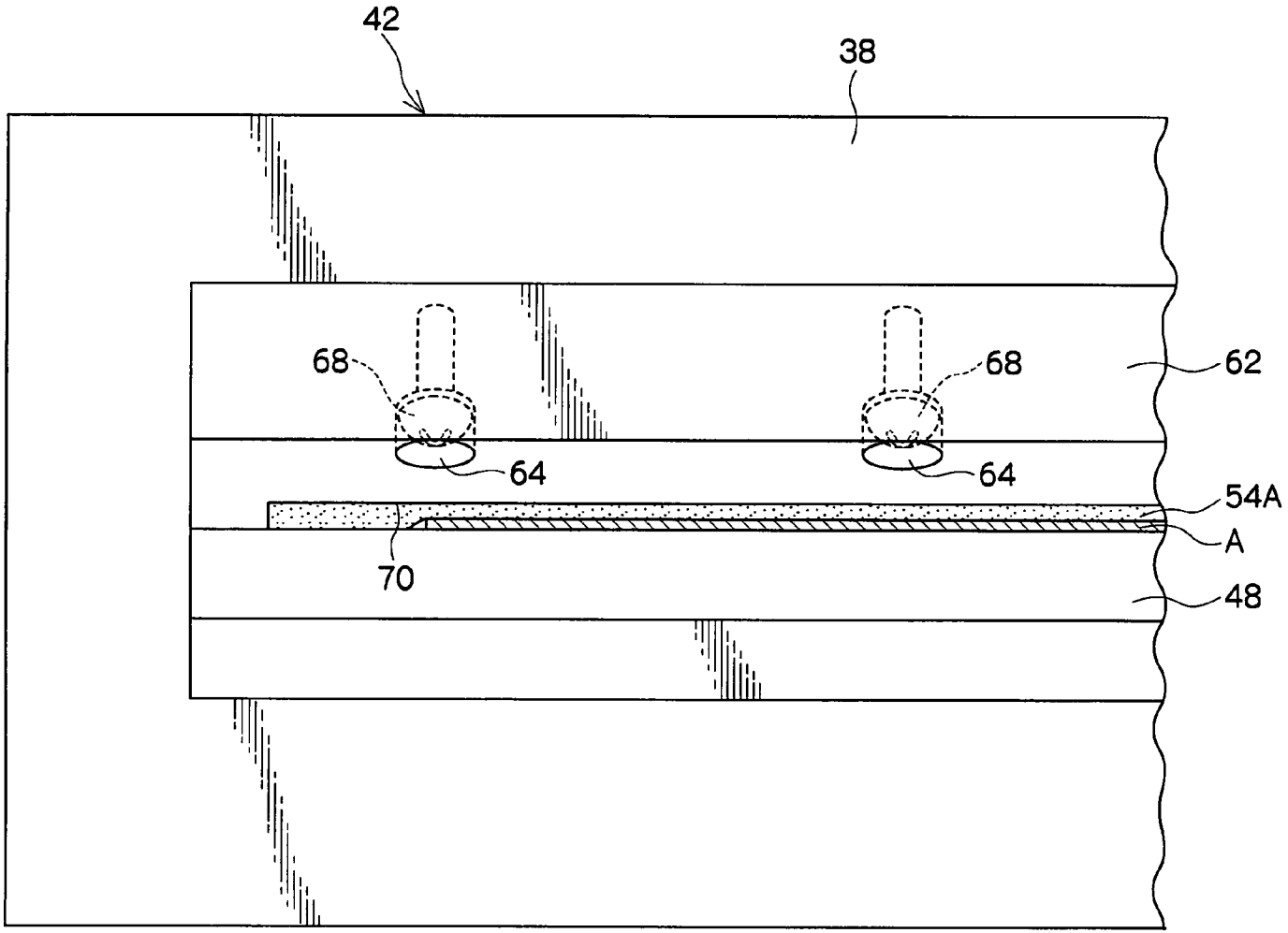
FIG. 4 is an enlarged front view of main portions showing, as seen from a first main body member side, the submerged conveying/processing device equipped with a squeezing function, relating to the embodiment of the present invention.

Through holes 64 are formed in the blade pushing member 62 at positions corresponding to the screw holes 56 at the blade attachment surface portion 50. Fit-together holes 66 are formed in the blade pushing member 62 at positions corresponding to the projections 58. Further, as shown in FIG. 4, a notch 70, which is for forming a slit through which the photosensitive material passes, is formed in the plate pushing member 62.

When the blade 54A formed in this way is to be attached to the first main body member 38, first, as shown in FIG. 3, the blade 54A is placed on the blade attachment surface portion 50 of the first main body member 38 in a state in which the projections 58 are inserted through the corresponding elongated holes 60 of the blade 54A and the elongated holes 60 are aligned with the corresponding screw holes 56.

Next, the blade pushing member 62 is positioned and placed, from above the blade 54A, such that the projections 58 are inserted through the corresponding fit-through holes 66. Screws 68 are inserted through the through holes 64 of the blade pushing member 62, and are fastened with the screw holes 56. Note that the blade 54A is fastened so as to be supported by a nipping force which enables the blade 54A to move relative to the first main bodymember 38 and the blade pushing member 62 at the time when the blade 54A thermally expands.

In this way, the blade 54A is set so as to be nipped between the blade attachment surface portion 50 and the blade pushing member 62, in a state in which the upper side edge of the blade 54A extending along the longitudinal direction and the vicinities of the longitudinal direction side ends of the blade 54A are fit tightly to the blade attachment surface portion 50.

A vicinity of the lower edge of the blade 54A placed in this way, which lower edge extends along the entire longitudinal direction length of the blade 54A, is elastically pressed so as to fit tightly against one wall surface of the slit 46. The longitudinal direction end portions of the blade 54A are held in a state of being inserted in the grooves 52.

As shown in FIG. 2, a check valve 72, which serves as a processing liquid changing mechanism (a liquid flow-out structure) and which is for making the processing liquid flow in the direction opposite to the conveying direction of the photosensitive material A, is provided at the first main body member 38. The check valve 72 is structured such that a valve member 78 is inserted with play in a circular through hole 76 which passes through rectilinearly, from the end surface of the first main body member 38 facing the interior of the second processing chamber 14 to the end surface of the first main body member 38 facing a processing space 74 which serves as a storing portion and which is formed between the first main body portion 38 and the second main body portion 40. A seal structuring portion 80, which is substantially conical, is provided at the head portion of the valve member 78 which head portion is directed toward the interior of the second processing chamber 14.

At the check valve 72 which is structured in this way, when the processing liquid attempts to flow from the processing space 74 toward the second processing chamber 14, the valve member 78 is pressed by the processing liquid and the seal structuring portion 80 is moved away from the opening of the circular through hole 76. As a result, the processing liquid flows freely from the processing space 74 through the circular through hole 76 toward the second processing chamber 14.

In contrast, when the processing liquid attempts to flow from the second processing chamber 14 toward the processing space 74, the seal structuring portion 80 of the valve member 78 which is pressed by the processing liquid closely contacts the opening of the circular through hole 76 and closes the circular through hole 76. The processing liquid is thereby prevented from flowing reversely from the second processing chamber 14 toward the processing space 74.

Next, description will be given of the second main body member 40 which is integral with the first main body member 38 and structures the housing 42.

A circulation groove portion 82, which is formed by cutting out a portion of the insertion opening guide surface portion 48 of the second main body member 40, is provided at the second main body member 40. Another check valve 72, which serves as a processing liquid changing mechanism (a liquid flow-in structure), is set at the second main body member 40 between the circulation groove portion 82 and the stepped end surface facing the interior of the third processing chamber 16.

Portions of the second main body member 40 other than the circulation groove portion 82 for the setting of the check valve 72, are structured the same as at the above-described first main body member 38. Further, the blade 54B (the exit closing member), which serves as the processing liquid passage preventing mechanism and which is provided at the second main body member 40, is structured similarly to and of the same material as the above-described blade 54A.

Figure 14:
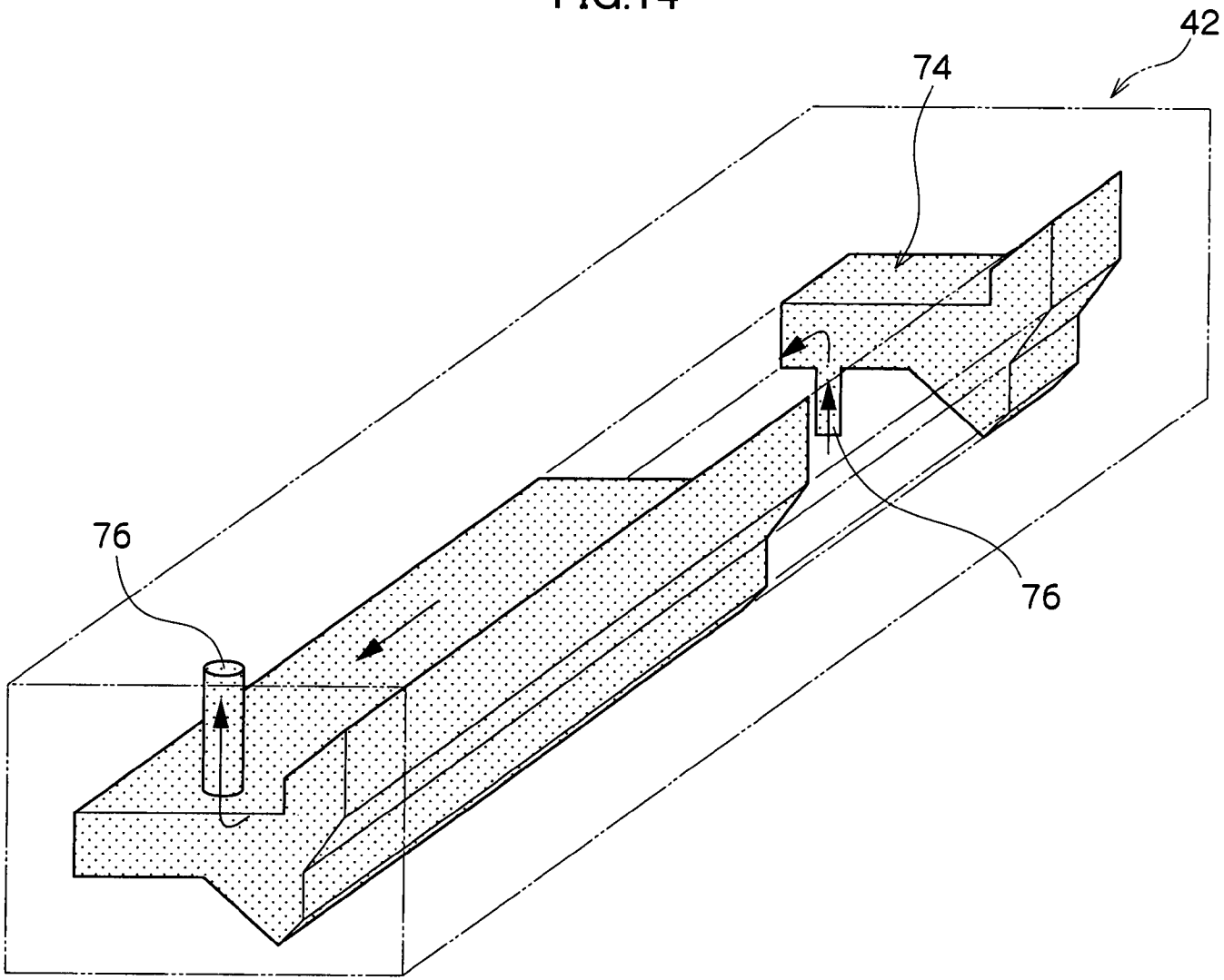
FIG. 14 is a schematic perspective view showing a structural example which relates to the submerged conveying/processing device equipped with a squeezing function pertaining to the embodiment of the present invention, and in which processing liquid is made to flow in from one circular through hole into a processing space, and is made to flow along the longitudinal direction of the processing space, and is made to flow out from another circular through hole, so as to change the processing liquid.
Figure 15:
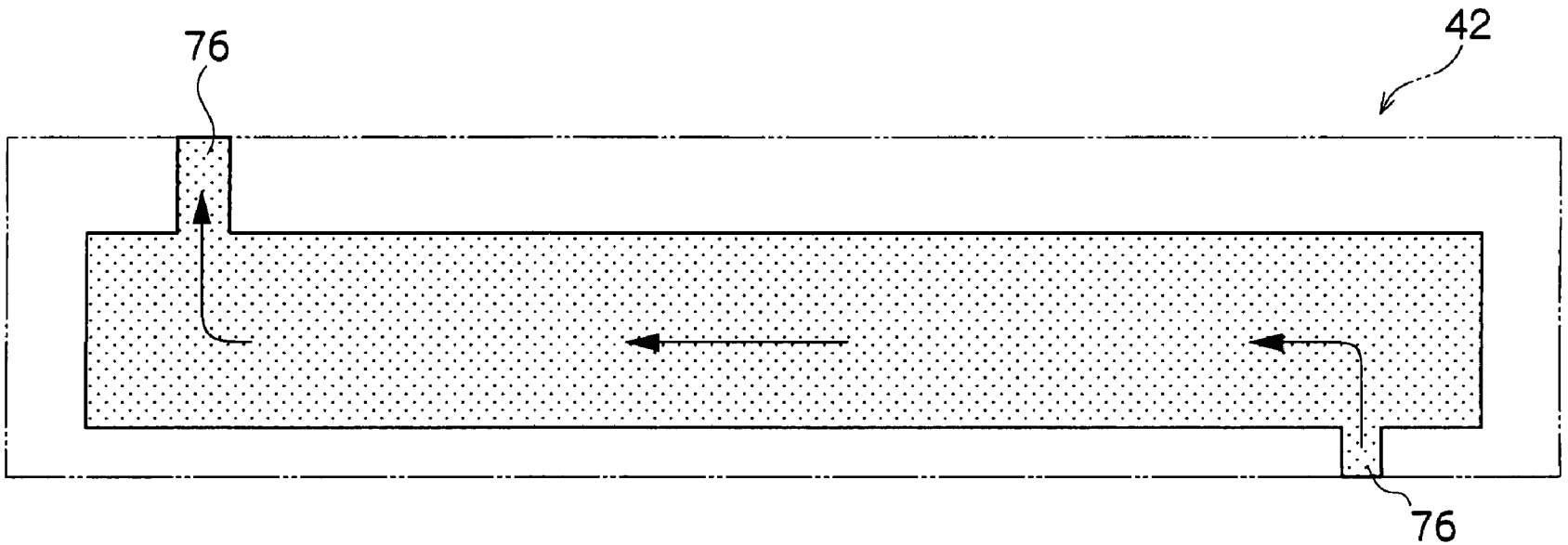
FIG. 15 is a schematic side view of the structural example illustrated in FIG. 14.

Further, as shown in FIGS. 14 and 15, the circular through hole 76, which is used for a check valve and is provided in the first main body member 38 of the housing 42, and the circular through hole 76, which is provided in the second main body member 40, are disposed near the both longitudinal direction end portions of the processing space 74. Note that, in the present application, "the both longitudinal direction end portions of the processing space 74" is defined to have a meaning which includes the both end portions along a single diagonal line of the processing space 74.

In this way, when the circular through hole 76 of the first main body member 38 and the circular through hole 76 of the second main body member 40 are provided, the processing liquid, which flows-in into the processing chamber 74 from one of the circular through holes 76 of one of the first main body member 38 and the second main body member 40, flows from one longitudinal direction end portion of the processing space 74 to the other end portion, and flows out from the other circular through hole 76. In this way, all of the processing liquid within the processing space 74 can be changed without leaving any behind.

The second main body member 40 is fastened integrally with the first main body member 38 and structures the housing 42, in a state in which an end surface 40A thereof, which is at the side at which the insertion opening guide surface portion 48 and the blade attachment surfaceportion 50 thereof are formed, is closely contacted with an end surface 38A of the first main body member 38 which end surface 38A is at the side at which the slit 46 is formed.

At the housing 42 which is structured in this way, the processing space 74, which is formed at the interior of the housing 42, is structured as a space which is enclosed by the blade 54A of the first main body member 38, the end surface 38A of the first main body member 38, a blade 54B of the second main body member 40 which blade 54B serves as an exit closing member, the insertion opening guide surface portion 48 of the second main body member 40, and the circulation groove portion 82 of the second main body member 40.

The size, in the conveying direction of the photosensitive material A, of the housing 42 which is structured in this way is a size which is accommodated in the space between the driving rollers 34A for conveying and the driving rollers 34B for conveying which form a portion of the conveying path.

Here, the driving rollers 34A for conveying and the driving rollers 34B for conveying are disposed within a range such that they can simultaneously nip and convey the photosensitive material A which is conveyed along the conveying path and has the minimum length in the conveying direction. (Usually, the driving rollers 34A for conveying and the driving rollers 34B for conveying are disposed at the positions which are the maximum distance apart within this range.)

Note that, although not illustrated, a play roller for guiding at the time of conveying the photosensitive material may be disposed between the driving rollers 34A for conveying and the driving rollers 34B for conveying, e.g., at a position within the processing space 74 of the housing 42 or the like.

As shown in FIG. 1, the submerged conveying devices 30 equipped with a squeezing function, which are set at the partitioning wall 22, the partitioning wall 26, and the partitioning wall 28 in the processing tank main body 10, are structured similarly to the first main body member 38 of the above-described submerged conveying/processing device 32 equipped with a squeezing function.

Note that, in the respective submerged conveying devices 30 equipped with a squeezing function, the structure of the check valve 72 at the first main body member 38 is omitted. Check valves 72A, which are structured similarly to the check valve 72, are set at predetermined places of the partitioning wall 22, the partitioning wall 26, and the partitioning wall 28.

At the processing tank main body 10 shown in FIG. 1, nipping rollers (not illustrated), which convey the washed photosensitive material A toward an unillustrated drying processing section, are disposed above the fifth processing chamber 20.

Moreover, although not illustrated, a water supply opening, which appropriately supplies fresh washing processing liquid to the fifth processing chamber 20, is disposed above the fifth processing chamber 20.

In addition, although not illustrated, an overflow pipe, which is for discharging washing processing liquid which has been used for a predetermined period of time or more, is provided at the first processing chamber 12. The used washing processing liquid which overflows is discharged to a storage tank or the like.

Next, the operation and workings of the submerged processing device for a photosensitive material, which relates to the present embodiment and is structured as described above, will be described.

The processing tank main body 10 shown in FIG. 1 accompanies the automatic developing device which develops the photosensitive material A. The exposed photosensitive material A is immersed in the developing liquid of an unillustrated developing tank of the automatic developing device, and thereafter, is immersed and processed in the fixing liquid of the fixing/bleaching tank. Thereafter, the photosensitive material A is conveyed into the first processing chamber 12 of the processing tank main body 10. The photosensitive material A, which has been conveyed into the first processing chamber 12, is washed by the wash water stored in the first processing chamber 12.

The photosensitive material A which has been washed in the first processing chamber 12 is sent by the driving rollers 34A for conveying to the submerged conveying device 30 equipped with a squeezing function. While elastically deforming the blade 54A of the conveying device 30, the photosensitive material A slides between the slit 46 and the blade 54A, and is squeezed and passes through without the processing liquid flowing in toward the second processing chamber 14, and is conveyed into the second processing chamber 14 by the driving rollers 34B for conveying.

After the photosensitive material A has passed through, the distal end portion of the blade 54A elastically returns and fits tightly to the wall surface of the slit 46 so as to be set in a sealing state of impeding flow-through of the processing liquid.

Next, the photosensitive material A, which has been conveyed into the second processing chamber 14 of the processing tank main body 10, is washed by the wash water stored in the second processing chamber 14.

The photosensitive material A which has been washed in the second processing chamber 14 is sent by the driving rollers 34A for conveying to the submerged conveying/processing device 32 equipped with a squeezing function.

At the submerged conveying/processing device 32 equipped with a squeezing function, as shown in FIG. 2, while elastically deforming the blade 54A disposed at the first main body member 38, the photosensitive material A which is being conveyed slides between the slit 46 and the blade 54A, and is squeezed and passes therethrough without the processing liquid in the second processing chamber 14 flowing in toward the processing space 74, and enters into the processing space 74.

The portion of the photosensitive material A which has entered into the processing space 74 is washed by the wash water stored in the processing space 74.

While advancing through the interior of the processing space 74 and elastically deforming the blade 54B of the second main body member 40, the photosensitive material A slides between the slit 46 and the blade 54B, and is squeezed and passes through without the processing liquid in the processing space 74 flowing in toward the third processing chamber 16, and is conveyed into the third processing chamber 16 by the driving rollers 34B for conveying.

When the photosensitive material A passes through the submerged conveying/processing device 32 equipped with a squeezing function as described above, the photosensitive material A is washed (processed) by the wash water (the processing liquid or solution) in the processing space 74. Therefore, the efficiency of washing the photosensitive material A (the efficiency of processing by the processing liquid) can be improved.

Note that, in order to improve the efficiency of washing the photosensitive material A (i.e., the efficiency of processing by the processing liquid) in a counter-current cascade type washing device in a general developing device, it suffices to increase the number of washing processing chambers. However, if the number of washing processing chambers is increased, the washing device becomes large on the whole. Accordingly, by providing and utilizing the submerged conveying/processing device 32 equipped with a squeezing function in a counter-current cascade type washing device, the washing device on the whole can be made to be compact, and, at the same time, the washing processing performance can be improved. For example, when the submerged conveying/processing device 32 is utilized, the time over which the photosensitive material A is submerged in the wash water can be shortened. Further, the amount of contamination of the wash water in the upstream-most washing processing chamber can be made to be low. Namely, when the submerged conveying/processing device 32 is used, the liquid concentration of the wash water in the upstream-most washing processing chamber can be made to be low, and the amount of chemicals remaining on the photosensitive material A can be reduced.

In addition, at the submerged conveying/processing device 32 equipped with a squeezing function, the amount of wash water (processing liquid) stored within the processing space 74 is small. Therefore, due to the action of the photosensitive material A passing through the interior of the processing space 74, the wash water (processing liquid) at the interior of the processing space 74 is sufficiently stirred without a difference in concentration arising therein. Therefore, a stirring mechanism such as a stirring pump or the like can be omitted, and the structure can be simplified.

Further, the entire submerged conveying/processing device 32 equipped with a squeezing function is immersed in the wash water (the processing liquid) within the processing tank main body 10, and the amount of the wash water (the processing liquid) within the processing space 74 is small. Therefore, even if no mechanism for adjusting the temperature of the wash water (the processing liquid) is provided within the processing space 74, the temperature of the wash water (the processing liquid) within the processing space 74 can be made to be equivalent to the temperature of the wash water (the processing liquids) stored in the first processing chamber 12 and in the second processing chamber 14. Thus, a temperature adjusting mechanism can be omitted, and the structure can be simplified.

Moreover, at the submerged conveying/processing device 32 equipped with a squeezing function, the photosensitive material A elastically deforms and passes by the two blades 54A and 54B simultaneously.

Accordingly, at the submerged conveying/processing device 32 equipped with a squeezing function, even if the photosensitive material A is strongly curled, the photosensitive material A is pressed against the flat surfaces of the slits 46 by the strong, total urging force of the two blades 54A and 54B (an urging force which is approximately twice the urging force of the single blade in the submerged conveying device 30 equipped with a squeezing function), and the curling of the photosensitive material A is suppressed. Therefore, it is possible to prevent the blade 54A and the blade 54B from being raised up by the curled photosensitive material A such that gaps form, and to prevent the wash water (the processing liquid) from flowing in and out of the processing space 74, and the squeezing performance can be improved.

At the double-blade-type submerged conveying/processing device 32 equipped with a squeezing function, if the driving rollers 34A for conveying are provided at the entrance side thereof, and the driving rollers 34B for conveying are provided at the exit side thereof, a structure is possible in which the photosensitive material A is made to pass by the two blades 54A and 54B. Namely, the submerged conveying/processing device 32 equipped with a squeezing function can be made to have a simple structure in which the two pairs of driving rollers 34A, 34B for conveying are disposed with respect to the two blades 54A, 54B which partition off the first processing space 74.

In contrast, in the single-blade-type submerged conveying device 30 equipped with a squeezing function, the two pairs of driving rollers 34A, 34B for conveying are needed for the one blade. Therefore, when a single processing chamber is partitioned off by using two of the submerged conveying devices 30 equipped with a squeezing function, four pairs of the driving rollers 34A, 34B for conveying are needed.

Thus, the double-blade-type submerged conveying/processing device 32 equipped with a squeezing function has the function of improving the processing capacity by increasing the number of independent processing chambers. Moreover, the total number of driving rollers for conveying can be reduced, and the number of parts can be reduced. In addition, the conveying path can be shortened, the processing time can be shortened, the processing efficiency can be improved, and the structure can be simplified and made more compact. As a result, the entire processing tank main body 10 can be made compact, and it is possible to provide an inexpensive product.

Next, the photosensitive material A, which has been conveyed into the third processing chamber 16 of the processing tank main body 10 from the submerged conveying/processing device 32 equipped with a squeezing function, is washed by the wash water stored in the third processing chamber 16 while being conveyed by the driving rollers 34B for conveying and the conveying rollers 36.

Further, the photosensitive material A is conveyed on the conveying path, and passes through the submerged conveying devices 30 equipped with a squeezing function, due to operations and workings which are similar to those of the above-described single-blade-type submerged conveying device 30 equipped with a squeezing function which is disposed between the first processing chamber 12 and the second processing chamber 14. The photosensitive material A which has passed through the conveying device 30 is conveyed to the fourth processing chamber 18 and the fifth processing chamber 20, and after the washing processings by the wash water therein has been completed, is conveyed to the unillustrated drying processing section.

Note that, in the above-described processing tank main body 10, replenishment of the wash water (processing liquid) is carried out by a so-called cascade method. For example, when fresh wash water (processing liquid) is replenished, in accordance with the processed amount of the photosensitive material A, to the fifth processing chamber 20 which is the processing chamber which is furthest downstream in the conveying direction of the photosensitive material A, the wash water (processing liquid) successively passes through the respective check valves 72A and check valves 72, and flows into the first processing chamber 12, and is discharged therefrom.

Further, the submerged conveying/processing device 32 equipped with a squeezing function, which relates to the present embodiment, has the following excellent effects.

The submerged conveying/processing device 32 equipped with a squeezing function is mainly structured by the first main body member 38, the second main body member 40, the blade 54A, the blade 54B, and the two blade pushing members 62. There are few parts, and assembly is easy.

Moreover, when the blade 54A and the blade 54B are to be replaced, the replacement work is easy because it can be carried out by removing the submerged conveying/processing device 32 equipped with a squeezing function to the exterior of the processing tank main body 10.

The blade 54A and the blade 54B are fixed so as to be relatively movable with respect to the first main body member 38 and the plate pushing member 62, or to the second main body member 40 and the plate pushing member 62 corresponding thereto. Therefore, even if the coefficients of linear expansion of the blade 54A and the blade 54B, and the first main body member 38 and the second main body member 40, or the like differ, dimensional errors arising due to changes in temperature are absorbed. Accordingly, no strain (undulations, wrinkles or the like) arises at the blade 54A and the blade 54B. The edges of the distal end lower sides of the blade 54A and the blade 54B are always reliably pushed against and fit tightly to the wall surfaces 46A of the slits 46 (i.e., the vertical wall surfaces 46A which are continuous with the insertion opening guide surface portions 48). Therefore, the sealability is good.

In addition, in the present embodiment, the first main body member 38, the second main body member 40 and the two blade pushing members 62 are formed of a synthetic resin containing glass fibers. Therefore, the amount of thermal deformation thereof can be kept small, and causes of strain can be reduced.

Next, description will be given of the results of a running test which was carried out in order to confirm the effects of the double-blade-type submerged conveying/processing device 32 equipped with a squeezing function at the processing tank main body 10 structured as shown in FIG. 1.

This running test was carried out at the processing tank main body 10 having the structure shown in FIG. 1 (hereinafter called a "vertical prototype processing device using double blades"). In this running test, an 8×10 inch size photosensitive material A was used. Wash water was replenished into the fifth processing chamber 20 such that the rate of replenishing the wash water with respect to the processed surface area of the photosensitive material A was 175 ml/m$^2$. The relationship between the processed amount of the photosensitive material A and the electrical conductivity (concentration) of the wash water within the third processing chamber 16 was measured.

Moreover, for comparison, a device was prepared (hereinafter called a "vertical prototype processing device using a single blade") in which the submerged conveying/processing device 32 equipped with a squeezing function in the processing tank main body 10 shown in FIG. 1 was replaced with the submerged conveying device 30 equipped with a squeezing function. The running test was carried out and measurement was performed under the same conditions at this processing tank main body which utilized only the submerged conveying devices 30 equipped with a squeezing function.

Figure 5:
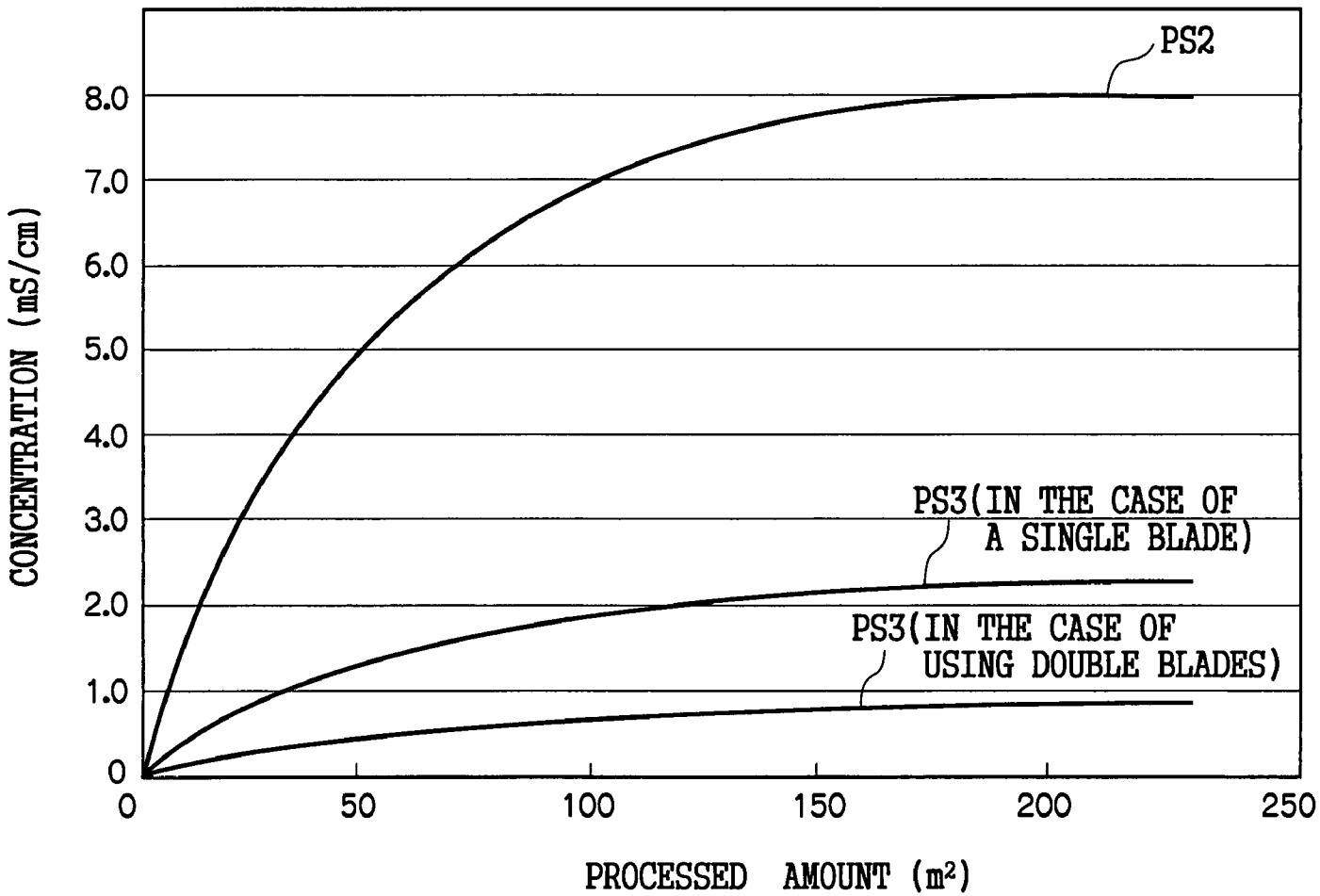
FIG. 5 is a graph showing results of measurement of a relationship between a processed amount of a photosensitive material and electrical conductivities of wash water within processing chambers, during a running test carried out in order to confirm the performance of the processing tank main body having the processing device for a photosensitive material relating to the embodiment of the present invention.

In the running test, the effects shown in following Table 1 and in FIG. 5 were obtained.

TABLE 1

| | equilibrium value (mS/cm) | |
|---|---|---|
| | only single blade | using double blades |
| PS1 | 20 | 20 |
| PS2 | 8 | 8 |
| PS3 | 2.3 | 0.8 |
| PS4 | 0.6 | 0.4 |

As can be understood from these results, when the electrical conductivity (concentration) of the wash water in the running test was in an equilibrium state, the electrical conductivity (concentration) of the wash water in the first processing chamber 12 (called PS1 here) and the electrical conductivity (concentration) of the wash water in the second processing chamber 14 (called PS2 here) were the same electrical conductivities (concentrations) at the vertical prototype processing device using a single blade and at the vertical prototype processing device using double blades.

Further, the electrical conductivity (concentration) of the wash water in the third processing chamber 16 (called PS3 here) only decreased to 2.3 mS/cm in the case of using a single blade, as compared with the great decrease to 0.8 mS/cm when using double blades.

In addition, the electrical conductivity (concentration) of the wash water in the fourth processing chamber 18 (called PS4 here) only decreased to 0.6 mS/cm in the case of using a single blade, as compared with the decrease to 0.4 mS/cm when using double blades.

From the results of the running test, it is clear that providing the one submerged conveying/processing device 32 equipped with a squeezing function has effects which are substantially equivalent to adding one processing chamber. Further, as compared with a counter-current cascade type washing device in a general developing device, the carry-over (the squeezing performance) is 30 ml/$m^2$ to 25 ml/$m^2$ in a general washing device, whereas the carry-over (the squeezing performance) can be improved to 10 ml/$m^2$ to 5 ml/$m^2$ in a case in which the submerged conveying/processing device 32 is provided. Therefore, the running test confirmed that the amount of replenishing water for a counter-current cascade type washing device could be cut in half.

Next, the usefulness of the double-blade-type submerged conveying/processing device 32 equipped with a squeezing function in the processing tank main body 10 having the structure shown in FIG. 1, adjusting the concentration of the processing liquid by changing the processing liquid within the processing space 74 by the check valve 72 (the liquid flow-in structure) and the check valve 72 (the liquid flow-out structure), will be described in comparison with the structure illustrated in FIG. 17.

Figure 17:
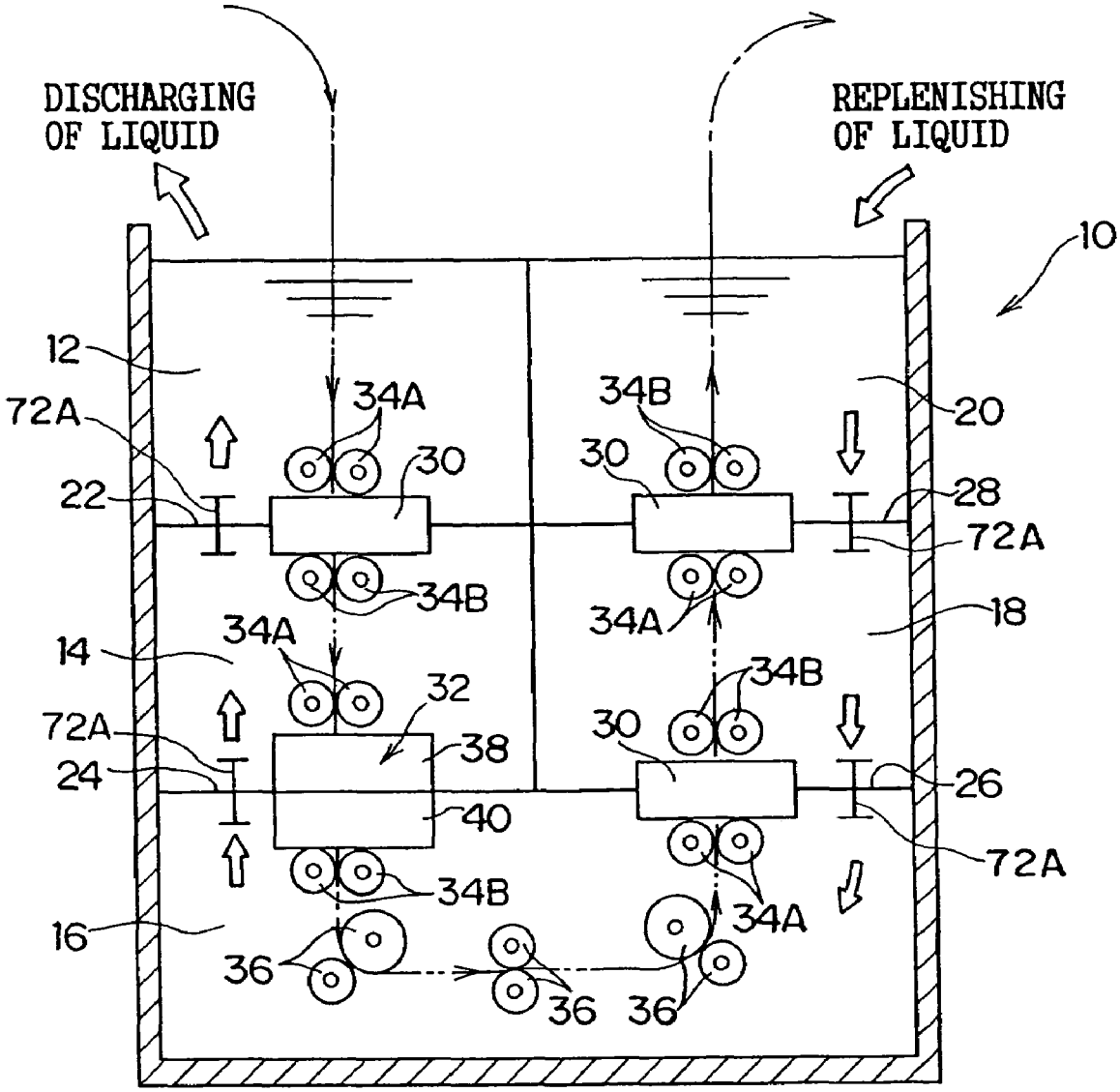
FIG. 17 is a schematic sectional side view showing a portion of a processing tank main body equipped with a submerged processing device, which is a comparative structural example for explaining the performance of the submerged processing device of FIG. 1.

In the processing tank main body 10 shown in FIG. 17, a submerged conveying/processing device 32A, which is disposed at the partitioning wall 24 between the second processing chamber 14 and the third processing chamber 16, is structured so as to not include the check valve 72 (the liquid flow-in structure) and the check valve 72 (the liquid flow-out structure). Namely, the submerged conveying/processing device 32A does not have the processing liquid changing mechanisms which communicate with the processing space 74.

Moreover, in the processing tank main body 10 illustrated in FIG. 17, a check valve 72A is provided at the partitioning wall 24 between the second processing chamber 14 and the third processing chamber 16. Note that, in the processing tank main body 10 shown in FIG. 17, structures other than those mentioned above are the same as those of the previously-described processing tank main body 10 shown in FIG. 1.

In the processing tank main body 10 shown in FIG. 17, the processing liquid in the third processing chamber 16 passes through the check valve 72A disposed at the partitioning wall 24, and flows from the third processing chamber 16 toward the second processing chamber 14. Moreover, the processing liquid stored in the processing space 74 of the submerged conveying/processing device 32A is in a state of being substantially left as is.

Therefore, when a given amount of the photosensitive material A is processed by the processing tank main body 10 shown in FIG. 17 and the concentration of the processing liquid in the processing space 74 of the submerged conveying/processing device 32A reaches an equilibrium state, the concentration of the processing liquid in the processing space 74 which is in an equilibrium state is substantially the same concentration as the concentration of the processing liquid stored in the second processing chamber 14.

In this state in which the concentration of the processing liquid stored in the second processing chamber 14 and the concentration of the processing liquid in the processing space 74 of the submerged conveying/processing device 32A are substantially the same concentration, when a running test which is similar to that described above is carried out, the following results are obtained: the electrical conductivity (concentration) of the wash water in the second processing chamber 14 is 8 mS/cm, and the electrical conductivity (concentration) of the. wash water in the third processing chamber 16 only drops to 2.3 mS/cm which is the same electrical conductivity (concentration) value as in the above-described vertical prototype processing device using a single blade.

Namely, the electrical conductivity (concentration) of the wash water in the second processing chamber 14 is the same electrical conductivity (concentration) value in the processing tank main body 10 of FIG. 1 and in the processing tank main body 10 of FIG. 17. Further, with regard to the electrical conductivity (concentration) of the wash water in the third processing chamber 16, the value thereof in the processing tank main body 10 of FIG. 1 is 0.8 mS/cm which is greatly reduced, whereas the value thereof in the processing tank main body 10 of FIG. 17 is only lowered to 2.3 mS/cm.

Thus, in the processing tank main body 10 shown in FIG. 1, the processing liquid in the second processing chamber 14 has a relatively high concentration, the processing liquid in the processing space 74 of the submerged conveying/processing device 32 has a relatively medium concentration, and the processing liquid in the third processing chamber 16 has a relatively low concentration. Therefore, it was confirmed that the ability to reduce by half the amount of replenishing water to a counter-current cascade type washing device could be exhibited. Namely, it was confirmed that, in the double-blade-type submerged conveying/processing device 32 equipped with a squeezing function, the ability to reduce by half the amount of replenishing water to a counter-current cascade type washing device could be exhibited owing to the combination of the squeezing function due to the blade 54A and the blade 54B which structure the double blades, and the processing liquid changing effect of changing the processing liquid stored in the processing space 74 by the check valve 72 (the liquid flow-in structure) and the check valve 72 (the liquid flow-out structure).

Note that, in the above-described embodiment, description is given of a structure in which the submerged conveying/processing device 32 equipped with a squeezing function is provided at one place on the conveying path within the processing tank main body 10. However, the submerged conveying/processing device 32 equipped with a squeezing function may be provided, in place of the submerged conveying device 30 equipped with a squeezing function, at the partitioning wall 22, the partitioning wall 24, the partitioning wall 26, or the partitioning wall 28 within the processing tank main body 10, or at all of the partitioning walls 22, 24, 26, 28. In addition, the submerged conveying/processing device 32 equipped with a squeezing function may be structured such that a plurality of the first main body member 38 or the second main body member 40 are placed one on another, so as to utilize three or more blades. In the case of a structure such as that described above, the performance and efficiency of the washing processing can be improved even more.

Next, other structural examples relating to the blade 54A and the blade 54B, which serve as the processing liquid passage preventing mechanisms in the double-blade-type submerged conveying/processing device 32 equipped with a squeezing function, will be described with reference to FIGS. 6 through 12.

Figure 6:
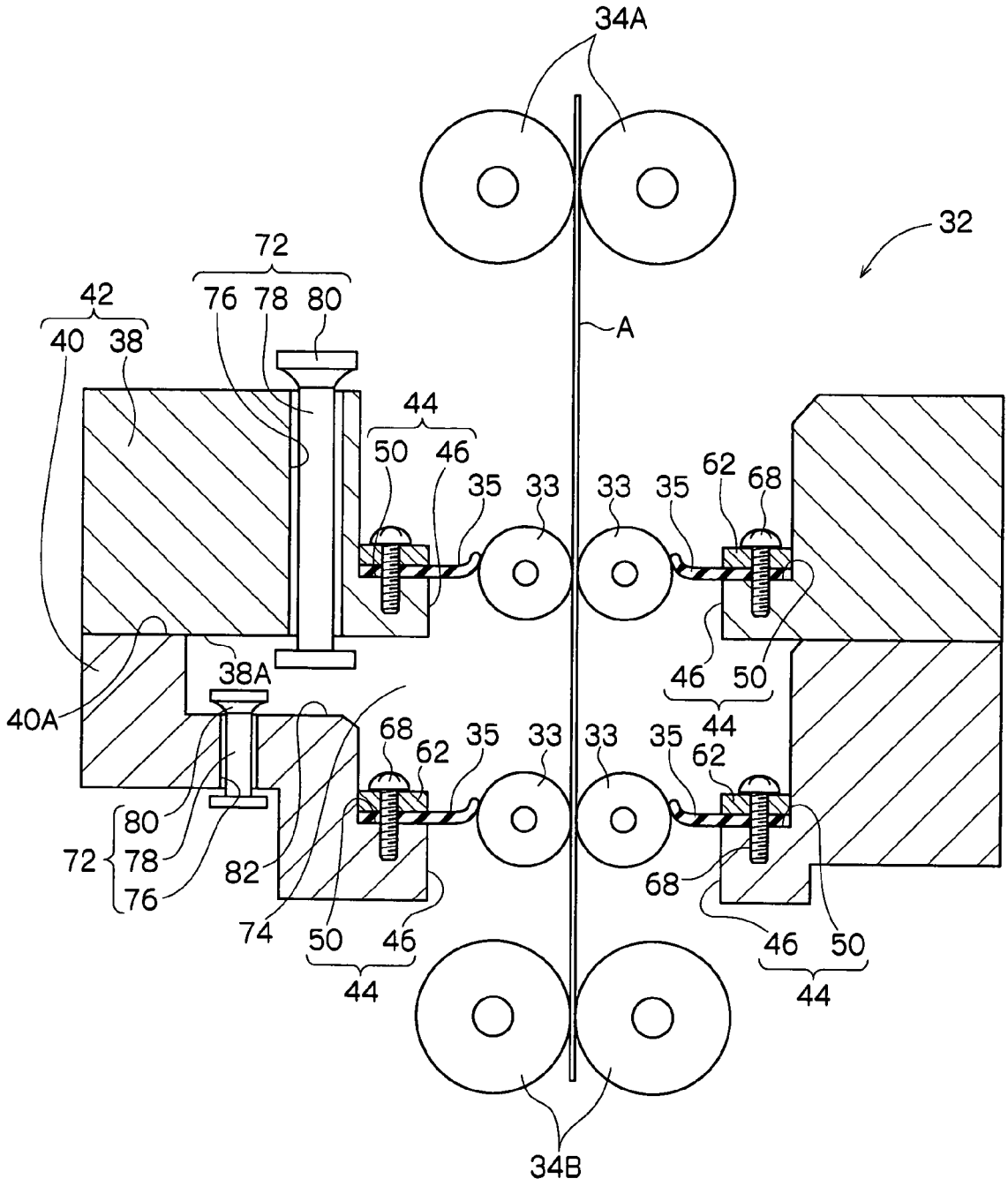
FIG. 6 is a schematic sectional front view showing another structural example relating to the submerged conveying/processing device equipped with a squeezing function pertaining to the embodiment of the present invention.

In the other structural example of the processing liquid passage preventing mechanism in the submerged conveying/processing device 32 equipped with a squeezing function which is illustrated in FIG. 6, the photosensitive material conveying paths 44 at the entrance side and the exit side, which communicate with the processing space 74, are partitioned by using two sets of the pair of the conveying rollers 33 and the two sealing blade members 35.

Namely, within each of the photosensitive material conveying paths 44 of the first main body member 38 and the second main body member 40 in the housing 42, the pair of conveying rollers 33 are mounted at the substantially central portion of the conveying path of the photosensitive material, such that the rotational axes thereof are parallel to one another, and such that the pair of conveying rollers 33 abut one another, and such that the pair of conveying rollers 33 are able to rotate freely.

Further, the spaces between the conveying rollers 33 and the side walls of the photosensitive material conveying path 44 are sealed by sealing structures (liquid-tight structures) utilizing the sealing blade members 35. The photosensitive material conveying path 44 has the slit hole 46 of a fixed width which is formed so as to be long along the transverse direction of the photosensitive material, and has blade mounting surface portions 50.

The proximal end portion of the sealing blade member 35 is placed on the blade mounting surface portion 50 formed at the side surface of the photosensitive material conveying path 44, and a blade pushing member 62 is placed thereon and fastened by using a screw 68. Further, the free end portion of the sealing blade member 35 is structured so as to slidingly contact the outer peripheral surface of the conveying roller 33 corresponding thereto, and form a seal.

In this processing liquid passage preventing structure, the photosensitive material A passes through between the pair of conveying rollers 33 while the processing liquid is squeezed therefrom, and passage of the processing liquid is also prevented.

Figure 7:
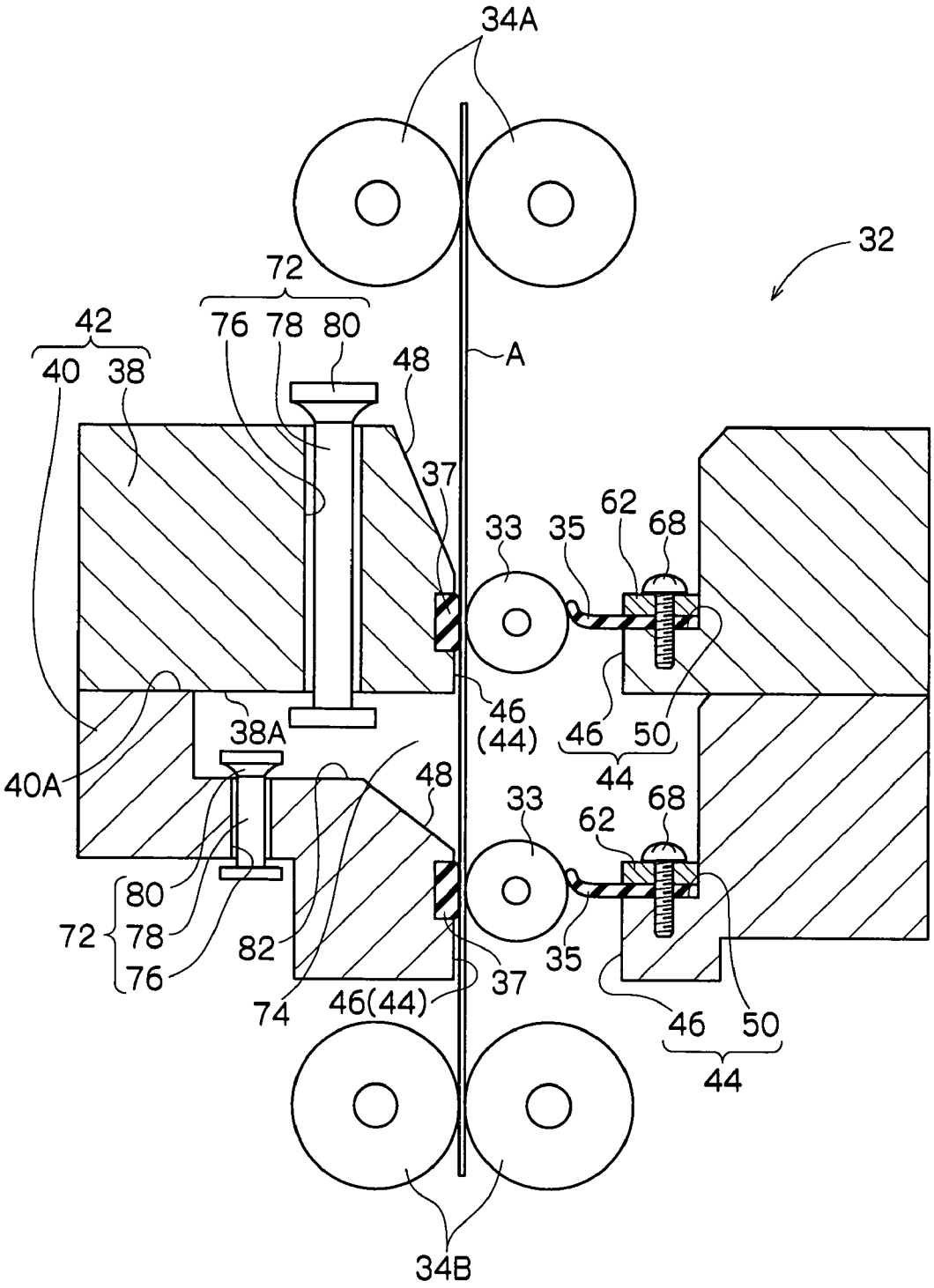
FIG. 7 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 7, will be described.

In this other structural example of the processing liquid passage preventing mechanism, the photosensitive material conveying paths 44 at the entrance side and the exit side, which communicate with the processing space 74, are partitioned by using two sets of the conveying roller 33 and the sealing blade member 35.

Namely, within each of the photosensitive material conveying paths 44 of the first main body member 38 and the second main body member 40 in the housing 42, the conveying roller 33 is disposed at the substantially central portion of the conveying path of the photosensitive material, and is mounted so as to be able to rotate freely.

Further, the space between the conveying roller 33 and one of the side surfaces of the photosensitive material conveying path 44 is sealed by a sealing structure (a liquid-tight structure) utilizing the sealing blade member 35. The space between the conveying roller 33 and the other side surface of the photosensitive material conveying path 44 (i.e., the slit hole 46) is sealed by a sealing structure (a liquid-tight structure) using a sealing sliding-contact member 37 which will be described later.

The photosensitive material conveying path 44 has the slit hole 46 of a fixed width which is formed so as to be long along the transverse direction of the photosensitive material, and has the blade mounting surface portion 50.

The proximal end portion of the sealing blade member 35 is placed on the blade mounting surface portion 50 formed at one of the side surfaces of the photosensitive material conveying path 44, and the blade pushing member 62 is placed thereon and fastened by using the screw 68. Further, the free end portion of the sealing blade member 35 is structured so as to slidingly contact the outer peripheral surface of the conveying roller 33 corresponding thereto, and form a seal.

The sealing sliding-contact member 37, which is formed of a material which is elastically deformable and has excellent sliding-contact wear resistance, is embedded in the wall at a predetermined position of the other side surface of the photosensitive material conveying path 44 (the slit hole 46) which either the outer peripheral surface of the conveying roller 33 or the surface of the photosensitive material A slidingly contacts. Note that a structure may be used in which the outer peripheral surface of the conveying roller 33 is formed of a material which is elastically deformable and has excellent sliding-contact wear resistance, and the conveying roller 33 directly slidingly contacts and seals (makes liquid-tight) the photosensitive material conveying path 44 (the slit hole 46).

In this processing liquid passage preventing mechanism, the photosensitive material A passes through between the conveying roller 33 and the sealing sliding-contact member 37 while the processing liquid is squeezed therefrom, and passage of the processing liquid is also prevented.

Figure 8:
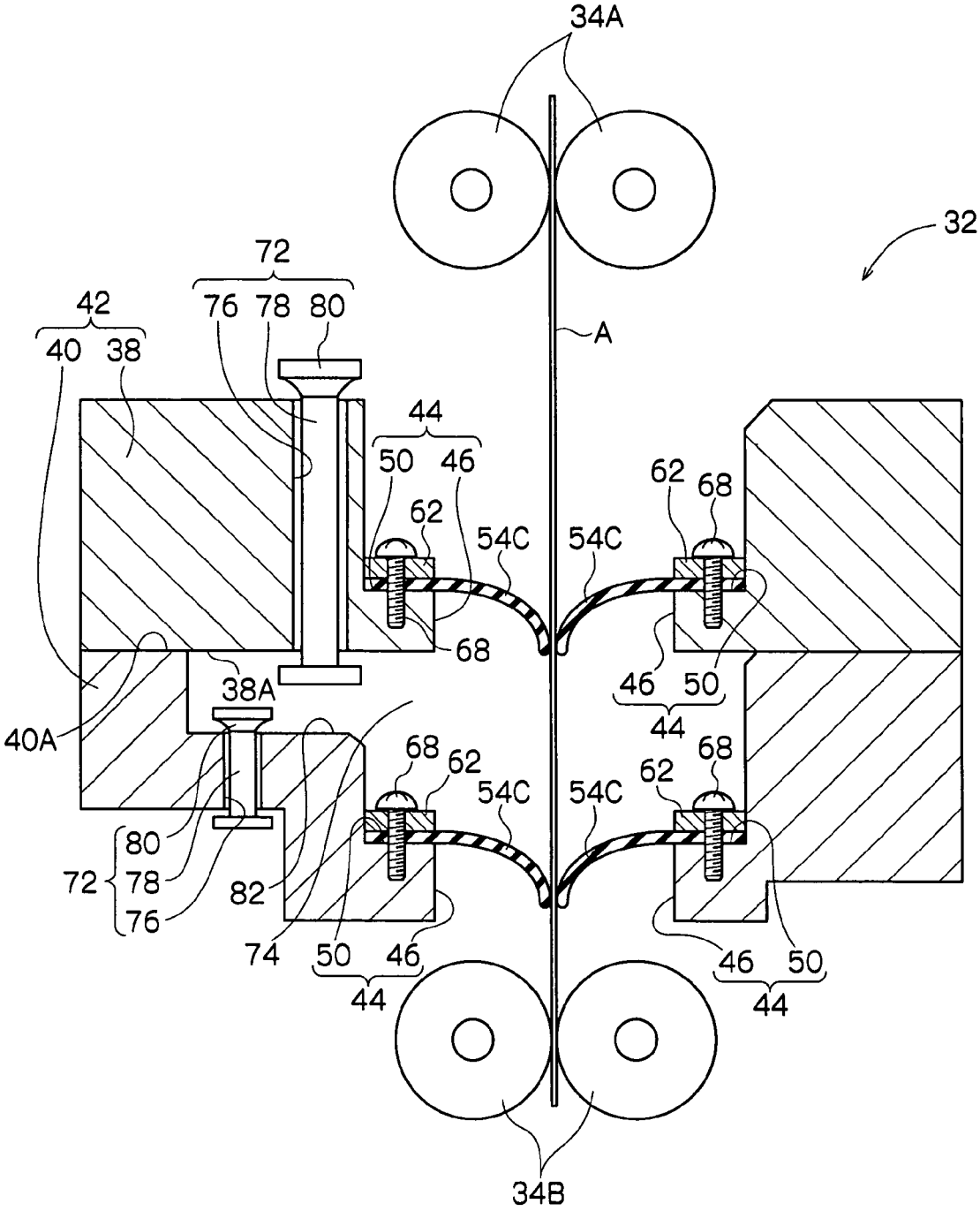
FIG. 8 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 8, will be described.

In this other structural example of the processing liquid passage preventing mechanism illustrated in FIG. 8, the photosensitive material conveying paths 44 at the entrance side and the exit side, which communicate with the processing space 74, are partitioned by using two sets of a pair of blades 54C which are disposed so as to oppose one another. At the side surface portions which face the front and reverse surfaces of the photosensitive material A, the photosensitive material conveying path 44 has the slit hole 46 of a fixed width which is formed so as to be long along the transverse direction of the photosensitive material, and has the blade mounting surface portions 50.

The proximal end portions of the blades 54C are placed on the blade mounting surface portions 50 formed at the respective side surfaces of the photosensitive material conveying path 44, and the blade pushing members 62 are placed thereon and fastened by using the screws 68. Further, the free end portions of the blades 54C are structured so as to press-contact one another without a gap therebetween.

In this processing liquid passage preventing mechanism, the photosensitive material A passes through between the two blades 54C, which press-contact one another, while the processing liquid is squeezed from the photosensitive material A. Further, at times when the photosensitive material A is not passing through, passage of the processing liquid is prevented by the free end portions of the two blades 54C which oppose one another press-contacting one another.

Figure 9:
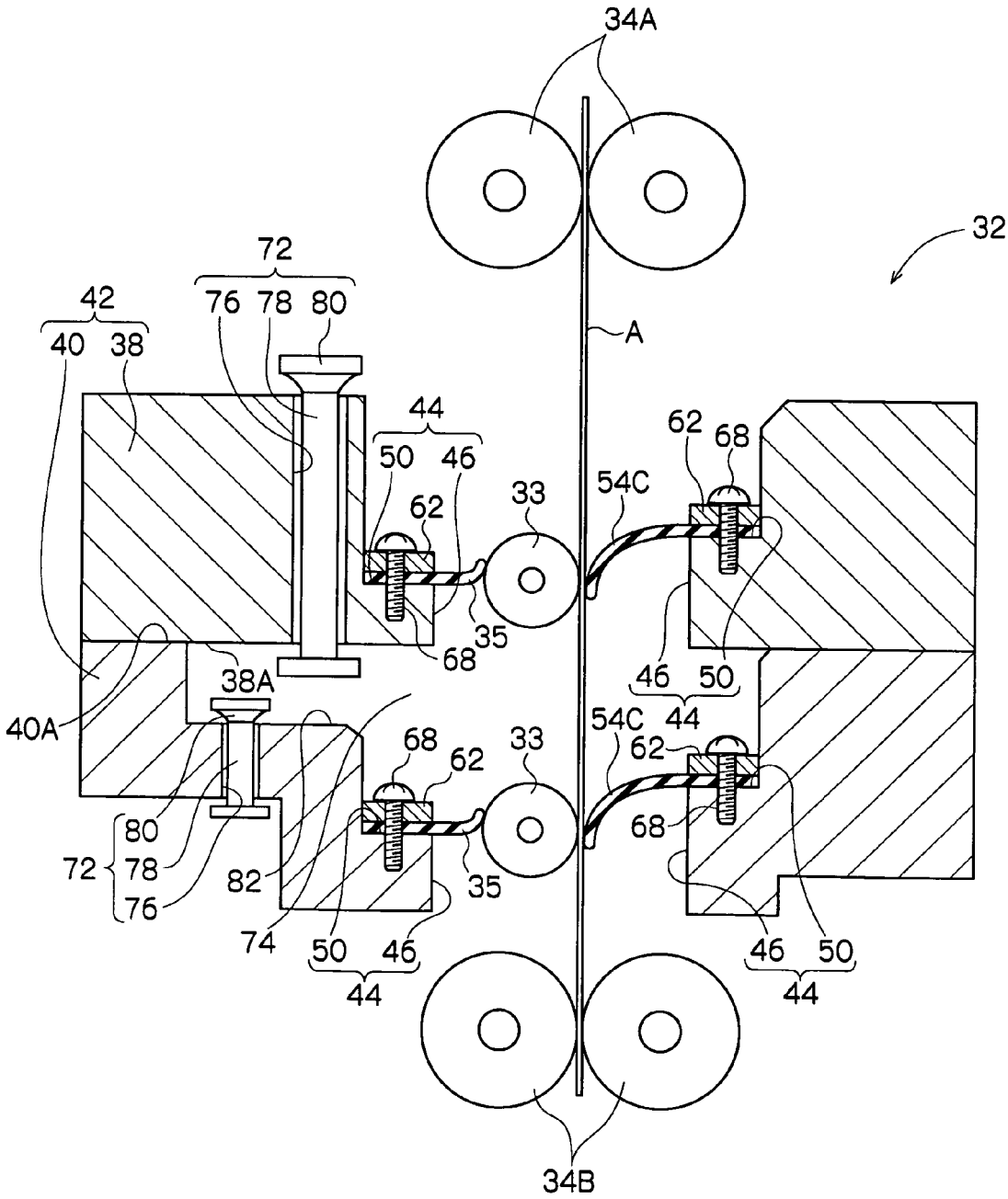
FIG. 9 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 9, will be described.

In this other structural example of the processing liquid passage preventing mechanism in the submerged conveying/processing device 32, which structural example is illustrated in FIG. 9, the photosensitive material conveying paths 44 at the entrance side and the exit side, which communicate with the processing space 74, are partitioned by using two sets of one of the conveying rollers 33, one of the blades 54C, and one of the sealing blade members 35.

Namely, within each of the photosensitive material conveying paths 44 of the first main body member 38 and the second main body member 40 in the housing 42, one of the conveying rollers 33 is disposed at the substantially central portion of the conveying path of the photosensitive material, and is mounted so as to be able to rotate freely.

Further, the space between the conveying roller 33 and one of the side walls of the photosensitive material conveying path 44 is sealed by a sealing structure utilizing the blade 54C. The space between the conveying roller 33 and the other side surface of the photosensitive material conveying path 44 is sealed by a sealing structure using the sealing blade member 35. The photosensitive material conveying path 44 has the slit hole 46 of a fixed width which is formed so as to be long along the transverse direction of the photosensitive material, and has the blade mounting surface portions 50.

The respective proximal end portions of the blade 54C and the sealing blade member 35 are placed on the blade mounting surface portions 50 formed at the side surfaces of the photosensitive material conveying path 44, and the blade pushing members 62 are placed thereon and fastened by using the screws 68. Further, the respective free end portions of the blade 54C and the sealing blade member 35 are structured so as to slidingly contact the outer peripheral surface of the conveying roller 33 corresponding thereto, and form seals (liquid-tight structures).

In this processing liquid passage preventing mechanism, the photosensitive material A passes through between the conveying roller 33 and the blade 54C while the processing liquid is squeezed therefrom, and passage of the processing liquid is also prevented.

Figure 10:
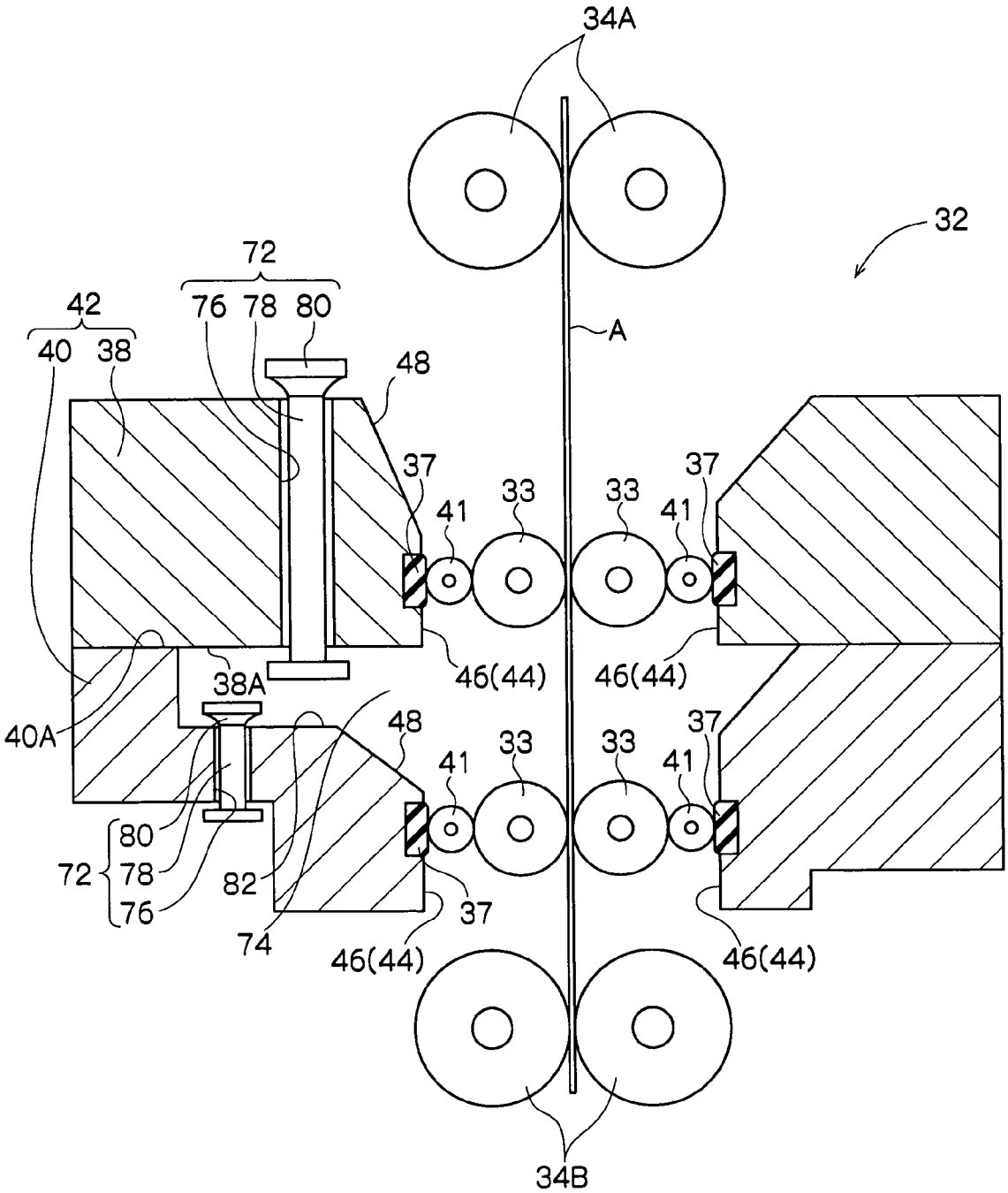
FIG. 10 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 10, will be described.

In the submerged conveying/processing device 32 equipped with a squeezing function, the photosensitive material conveying paths 44 at the entrance side and the exit side, which communicate with the processing space 74, are partitioned by using two sets of the pair of conveying rollers 33 and two rollers 41 for sealing.

Namely, in the same way as the structural example shown in FIG. 6, within each of the photosensitive material conveying paths 44, the pair of conveying rollers 33 are mounted at the substantially central portion of the conveying path of the photosensitive material, such that the rotational axes thereof are parallel to one another, and such that the pair of conveying rollers 33 abut one another, and such that the pair of conveying rollers 33 are able to rotate freely.

Further, the spaces between the conveying rollers 33 and the side surfaces of the photosensitive material conveying path 44 (i.e., the slit hole 46) are sealed by sealing structures using the rollers 41 for sealing. The rollers 41 for sealing are mounted to predetermined positions in the conveying path of the photosensitive material, such that the rotational axes thereof are parallel to those of the corresponding conveying rollers 33, and such that the rollers 41 for sealing abut the conveying rollers 33, and such that the rollers 41 for sealing are able to rotate freely.

The sealing sliding-contact members 37, which are formed of a material which is elastically deformable and has excellent sliding-contact wear resistance, are embedded in the walls at predetermined positions of the side surfaces of the photosensitive material conveying path 44 (the slit hole 46) which the rollers 41 for sealing slidingly contact. Note that a structure may be used in which the outer peripheral surfaces of the rollers 41 for sealing are formed of a material which is elastically deformable and has excellent sliding-contact wear resistance, and the rollers 41 for sealing slidingly contact the wall surfaces (the slit hole 46) of the photosensitive material conveying path 44 directly, so as to form seals (liquid-tight structures).

In this processing liquid passage preventing mechanism, the photosensitive material A passes through between the pair of conveying rollers 33 while the processing liquid is squeezed therefrom, and passage of the processing liquid is also prevented.

Figure 11:
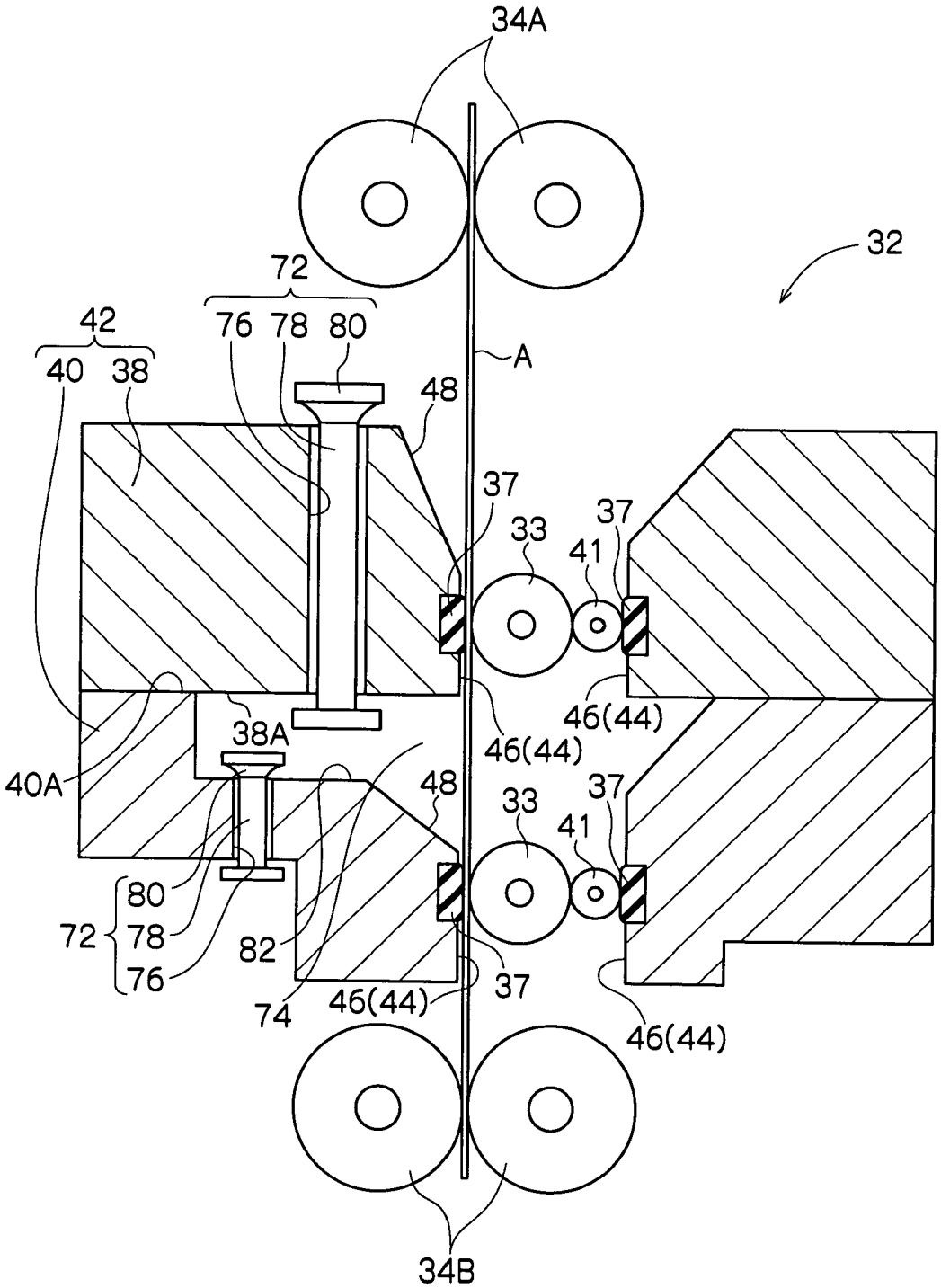
FIG. 11 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 11, will be described.

In this processing liquid passage preventing mechanism, the photosensitive material conveying paths 44 at the entrance side and the exit side, which communicate with the processing space 74, are partitioned by using two sets of one of the conveying rollers 33 and one of the rollers 41 for sealing.

Namely, the conveying rollers 33 are mounted so as to be freely rotatable within the respective photosensitive material conveying paths 44. Further, the space between the conveying roller 33 and one side surface of the photosensitive material conveying path 44 (i.e., the slit hole 46) is sealed by a sealing structure (a liquid-tight structure) using the roller 41 for sealing. The roller 41 for sealing is mounted to a predetermined position in the conveying path of the photosensitive material, such that the rotational axis thereof is parallel to that of the corresponding conveying roller 33, and such that the roller 41 for sealing abuts the conveying roller 33, and such that the roller 41 for sealing is able to rotate freely.

The sealing sliding-contact member 37, which is formed of a material which is elastically deformable and has excellent sliding-contact wear resistance, is embedded in the wall at a predetermined position of the side surface of the photosensitive material conveying path 44 (the slit hole 46) which the roller 41 for sealing slidingly contacts. Note that a structure may be used in which the outer peripheral surface of the roller 41 for sealing is formed of a material which is elastically deformable and has excellent sliding-contact wear resistance, and the roller 41 for sealing slidingly contacts the wall surface of the photosensitive material conveying path 44 (the slit hole 46) directly, so as to form a seal (a liquid-tight structure).

Further, the sealing sliding-contact member 37, which is formed of a material which is elastically deformable and has excellent sliding-contact wear resistance, is embedded in the wall at a predetermined position of the other side surface of the photosensitive material conveying path 44 (the slit hole 46) which the outer peripheral surface of the conveying roller 33 or the surface of the photosensitive material A slidingly contacts. Note that a structure may be used in which the outer peripheral surface of the conveying roller 33 is formed of a material which is elastically deformable and has excellent sliding-contact wear resistance, and the conveying roller 33 directly slidingly contacts the photosensitive material conveying path 44, and forms a seal (a liquid-tight structure).

In this processing liquid passage preventing mechanism, the photosensitive material A passes through between the conveying roller 33 and the sealing sliding-contact member 37 while the processing liquid is squeezed from the photosensitive material A, and passage of the processing liquid is also prevented.

Figure 12:
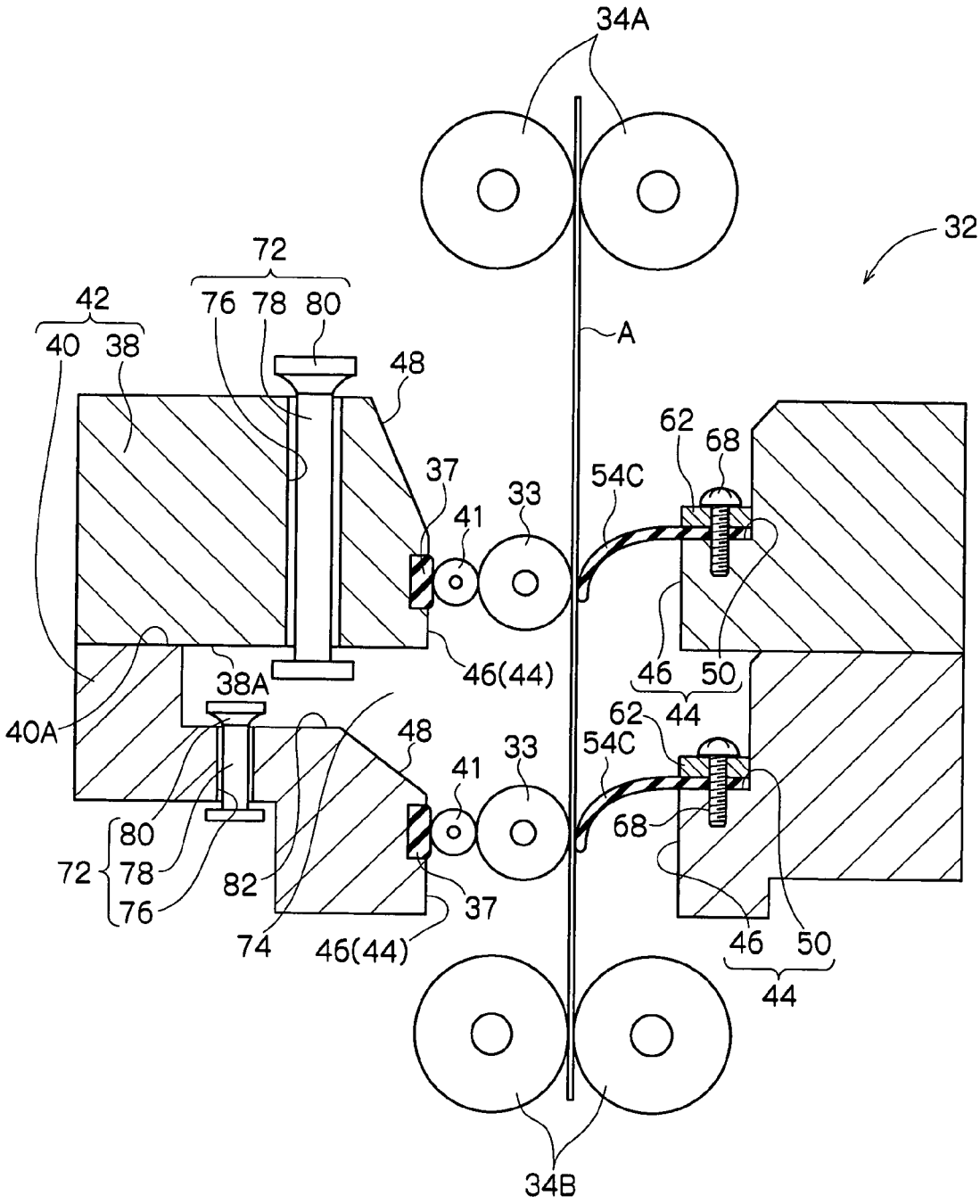
FIG. 12 is a schematic sectional front view showing another structural example relating to the submerged conveying/processing device equipped with a squeezing function pertaining to the embodiment of the present invention.

Next, another structural example of a processing liquid passage preventing mechanism in the submerged conveying/processing device 32, which structural example is illustrated in FIG. 12, will be described.

In this processing liquid passage preventing mechanism, the photosensitive material conveying paths 44 at the entrance side and the exit side, which communicate with the processing space 74, are partitioned by using two sets of one of the conveying rollers 33, one of the rollers 41 for sealing, and one of the blades 54C.

Namely, the conveying rollers 33 are mounted so as to be freely rotatable within the respective photosensitive material conveying paths 44. Further, the space between the conveying roller 33 and one side surface of the photosensitive material conveying path 44 (i.e., the slit hole 46) is sealed by a sealing structure (a liquid-tight structure) using the roller 41 for sealing. The roller 41 for sealing is mounted to a predetermined position in the conveying path of the photosensitive material, such that the rotational axis thereof is parallel to that of the corresponding conveying roller 33, and such that the roller 41 for sealing abuts the conveying roller 33, and such that the roller 41 for sealing is able to rotate freely.

The sealing sliding-contact member 37, which is formed of a material which is elastically deformable and has excellent sliding-contact wear resistance, is embedded in the wall at a predetermined position of the side surface of the photosensitive material conveying path 44 (the slit hole 46) which the roller 41 for sealing slidingly contacts. Note that a structure may be used in which the outer peripheral surface of the roller 41 for sealing is formed of a material which is elastically deformable and has excellent sliding-contact wear resistance, and the roller 41 for sealing slidingly contacts the wall surface of the photosensitive material conveying path 44 (the slit hole 46) directly, and forms a seal (a liquid-tight structure).

Further, the space between the conveying roller 33 and the other side surface of the photosensitive material conveying path 44 (the slit hole 46) is sealed by a sealing structure (a liquid-tight structure) utilizing the blade 54C. The photosensitive material conveying path 44 has the slit hole 46 of a fixed width which is formed so as to be long along the transverse direction of the photosensitive material, and has the blade mounting surface portion 50.

The proximal end portion of the blade 54C is placed on the blade mounting surface portion 50 formed at one side surface of the photosensitive material conveying path 44, and the blade pushing member 62 is placed thereon and fastened by using the screw 68. Further, the free end portion of the blade 54C is structured so as to slidingly contact the outer peripheral surface of the corresponding conveying roller 33, and form a seal (a liquid-tight structure).

In this processing liquid passage preventing mechanism, the photosensitive material A passes through between the conveying roller 33 and the blade 54C while the processing liquid is squeezed from the photosensitive material A, and passage of the processing liquid is also prevented.

Note that structures, operations and effects, which were not explained, of the respective processing liquid passage preventing mechanism illustrated in FIGS. 7 through 12 are similar to those of the previously-described embodiment illustrated in FIGS. 1 through 4 and FIG. 6, and therefore, description thereof is omitted.

Next, another structural example, used instead of the check valve 72 as the processing liquid changing mechanism in the submerged conveying/processing device 32 equipped with a squeezing function will be described with reference to FIG. 13.

Figure 13:
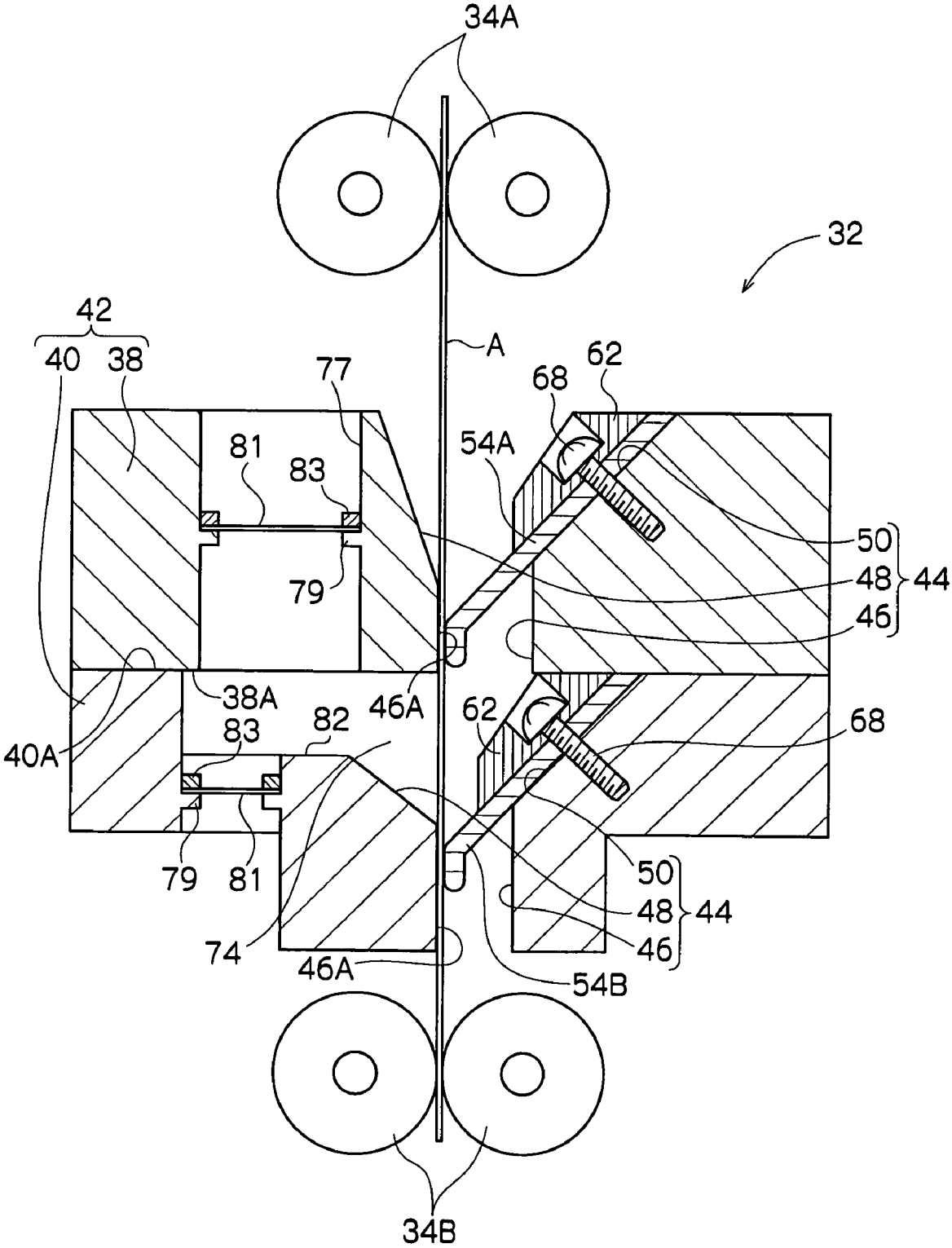
FIG. 13 is a schematic sectional front view showing another structural example relating to the submerged conveying/processing device equipped with a squeezing function pertaining to the embodiment of the present invention.

In the submerged conveying/processing device 32 equipped with a squeezing function and illustrated in FIG. 13, the processing liquid changing mechanism is structured by using a film member 81 through which the needed processing liquid passes. A through hole 77 is formed which has a predetermined large opening diameter and which passes through from the end surface of the first main body member 38 of the housing 42 which end surface faces the interior of the second processing chamber 14, to the end surface which is formed between the first main body member 38 and the second main body member 40 and faces the processing space 74. A supporting stand member 79, which projects in an annular form from the inner peripheral surface of the through hole 77 toward the inner side thereof, is formed to project at a predetermined position within the through hole 77.

The periphery of the film member 81 is placed on the supporting stand member 79. An annular presser member 83 is placed thereon, such that the film member 81 is engaged by an unillustrated engaging mechanism. In this way, the film member 81 is disposed within the through hole 77 in a state in which the periphery of the film member 81 is nipped by the supporting stand member 79 and the presser member 83.

Similarly, at the second main body member 40 of the housing 42, a processing liquid changing mechanism using the film member 81 is formed between a flow path groove portion 82 of the second main body member 40 and the step-shaped end surface facing the interior of the third processing chamber 16. In the processing liquid changing mechanism which uses the film member 81 and is provided at the second main body member 40, in the same way as the above-described structure disposed at the first main body member 38, the periphery of the film member 81 is nipped by the supporting stand member 79 and the presser member 83, such that the film member 81 is engaged by an unillustrated engaging mechanism.

A permeable membrane, an ultrafiltration membrane, an ion-exchange membrane, a membrane filter, a microfilter, or the like can be used as the film member 81 serving as the processing liquid changing mechanism. By utilizing the function of the film member 81 set therein, the processing liquid changing mechanism using the film member 81 makes the concentration of the processing liquid stored within the processing space 74 lower than the concentration of the processing liquid in the second processing chamber 14 in the above-described counter-current cascade type processing tank main body 10. Further, the processing liquid changing mechanism makes the concentration of the processing liquid stored in the processing space 74 greater than or equal to or less than the concentration of the processing liquid within the third processing chamber 16.

Further, the processing liquid changing mechanism mounted to the housing 42 may be any type of structure provided that it is structured so as to be able to change the processing liquid which is stored in the processing space 74. For example, the processing liquid changing mechanism may be structured such that a liquid flow-in tube and a liquid flow-out tube, which communicate with the interior of the processing space 74, are provided, and new processing liquid is introduced from the liquid flow-in tube, and old liquid discharged from the liquid flow-out tube.

Moreover, the processing liquid changing mechanism may be structured such that a liquid feed pump is provided, and for example, liquid is forcibly fed into the processing space 74 from the third processing chamber 16, and liquid is forcibly discharged from the processing space 74, for example, to the second processing chamber 14.

In addition, the processing liquid changing mechanism may be structured such that, within the processing space 74, not only is the processing liquid which exists in the processing tank main body 10 caused to flow in or flow out, but also, a completely different type of processing liquid (e.g., pure water) is circulated only in the processing space 74 or fed processing liquid is discharged as waste liquid.

Next, another structural example relating to the submerged conveying/processing device for a photosensitive material relating to the present embodiment will be described with reference to FIG. 16.

Figure 16:
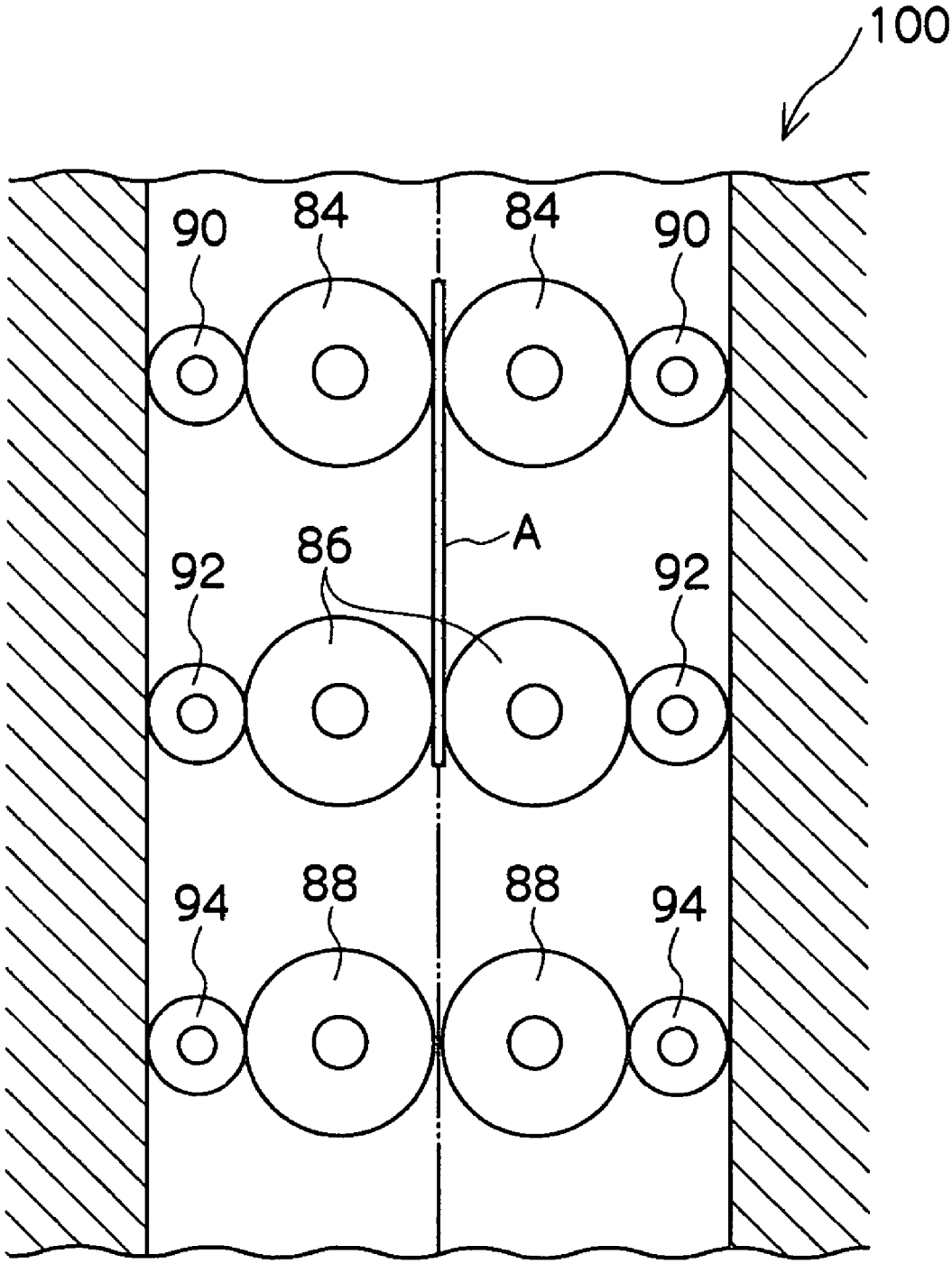
FIG. 16 is a sectional view of main portions showing another structural example relating to the submerged conveying/processing device for a photosensitive material relating to the embodiment of the present invention.

In a processing tank main body 100 shown in FIG. 16, the respective processing chambers are partitioned by using pairs of driving/conveying rollers and rollers for sealing, in place of the submerged conveying device 30 equipped with a squeezing function or the submerged conveying/processing device 32 equipped with a squeezing function. Namely, a pair of driving/conveying rollers 84 are disposed in the processing tank main body 100, rollers 90 for sealing are disposed within the spaces between the conveying rollers 84 and the inner walls of the processing tank main body 100 so as to partition the region of the processing tank main body 100 thereabove and the region of the processing tank main body 100 therebelow such that the wash water (processing liquid) does not flow between these respective regions.

Further, driving/conveying rollers 86 are disposed at positions separated from the driving/conveying rollers 84 by a distance such that the conveying direction length from the driving/conveying rollers 84 is shorter than the length of the shortest photosensitive material A. Rollers 92 for sealing are disposed within the spaces between the conveying rollers 86 and the inner walls of the processing tank main body 100 so as to partition the region of the processing tank main body 100 thereabove and the region of the processing tank main body 100 therebelow such that the wash water (processing liquid) does not flow between these respective regions. In this way, a processing chamber is formed between the driving/conveying rollers 84 and the driving/conveying rollers 86.

Driving/conveying rollers 88 are disposed at positions separated from the driving/conveying rollers 86 by a distance such that the conveying direction length from the driving/conveying rollers 86 is shorter than the length of the shortest photosensitive material A. Rollers 94 for sealing are disposed within the spaces between the conveying rollers 88 and the inner walls of the processing tank main body 100 so as to partition the region of the processing tank main body 100 thereabove and the region of the processing tank main body 100 therebelow such that the wash water (processing liquid) does not flow between these respective regions. In this way, another processing chamber is formed between the driving/conveying rollers 86 and the driving/conveying rollers 88. The desired number of processing chambers can thereby be formed within the processing tank main body 100. Note that, although not illustrated, mechanisms such as a valve cascade or the like for making the processing liquid flow through by a cascading method are provided between the respective processing chambers in the processing tank main body 100.

By utilizing such a structure, a plurality of processing chambers can be formed in continuation so as to be arranged in plural levels within the processing tank main body 100. In accordance with the processing tank main body 100 shown in FIG. 16, the conveying rollers used only in making the photosensitive material pass through the submerged conveying devices 30 equipped with a squeezing function are eliminated. By decreasing the total number of conveying rollers in this way, the conveying path can be shortened and processing can be made more rapid. In addition, the volume within each processing chamber is made to be small, the processing liquid is stirred automatically by the action of the photosensitive material A being conveyed, and the stirring efficiency can be improved. Further, even if the photosensitive material is curled, a good squeezing performance can be maintained because the force nipping the photosensitive material A at the conveying rollers can be made to be strong.

What is claimed is:

1. A submerged processing device for a photosensitive material, the submerged processing device being disposed at a partitioning wall which is provided within a processing tank main body and which is between processing chambers respectively storing a processing liquid, the submerged processing device comprising:

a housing at an interior of which is formed a processing space in which the processing liquid is stored;

a photosensitive material conveying path which is for conveying-in of the photosensitive material and which is formed in the housing so as to communicate with an interior of the processing space;

a photosensitive material conveying path which is for conveying-out of the photosensitive material and which is formed in the housing so as to communicate with the interior of the processing space;

a processing liquid passage preventing mechanism disposed at each of the photosensitive material conveying paths such that only the photosensitive material passes therethrough; and a processing liquid changing mechanism provided at the housing, for changing the processing liquid stored in the processing space.

2. A submerged processing device for a photosensitive material, the submerged processing device being disposed at a partitioning wall which is provided within a processing tank main body and which is between processing chambers respectively storing a processing liquid, the submerged processing device comprising:

a housing at an interior of which is formed a processing space in which the processing liquid is stored;

a photosensitive material conveying path which is for conveying-in of the photosensitive material and which is formed in the housing so as to communicate with an interior of the processing space;

a photosensitive material entrance side driving roller for conveying, disposed in a vicinity of an entrance of the photosensitive material conveying path which is for the conveying-in of the photosensitive material;

a photosensitive material conveying path which is for conveying-out of the photosensitive material and which is formed in the housing so as to communicate with the interior of the processing space;

a photosensitive material exit side driving roller for conveying, disposed in a vicinity of an exit of the photosensitive material conveying path which is for the conveying-out of the photosensitive material, the photosensitive material exit side driving roller for conveying being a driving roller which is disposed firstly at a conveying direction downstream side of the photosensitive material entrance side driving roller for conveying;

a processing liquid passage preventing mechanism disposed at each of the photosensitive material conveying paths such that only the photosensitive material passes therethrough; and a processing liquid changing mechanism provided at the housing, for changing the processing liquid stored in the processing space.

3. A submerged processing device for a photosensitive material, the submerged processing device being disposed at a partitioning wall which is provided within a processing tank main body and which is between processing chambers respectively storing a processing liquid, the submerged processing device comprising:

a housing at an interior of which is formed a processing space in which the processing liquid is stored;

a photosensitive material conveying path which is for conveying-in of the photosensitive material and which is formed in the housing so as to communicate with an interior of the processing space;

a photosensitive material entrance side driving roller for conveying, disposed in a vicinity of an entrance of the photosensitive material conveying path which is for the conveying-in of the photosensitive material;

a photosensitive material conveying path which is for conveying-out of the photosensitive material and which is formed in the housing so as to communicate with the interior of the processing space;

a photosensitive material exit side driving roller for conveying, disposed in a vicinity of an exit of the photosensitive material conveying path which is for the conveying-out of the photosensitive material, the photosensitive material exit side driving roller for conveying being a driving roller which is disposed firstly at a conveying direction downstream side of the photosensitive material entrance side driving roller for conveying;

a blade provided so as to close and seal a slit hole forming the photosensitive material conveying path, and squeezing the photosensitive material passing through the slit hole by slidingly-contacting the photosensitive material, and preventing passage of the processing liquid;

a liquid flow-in structure, mounted to a position of the housing at one longitudinal direction end portion side of the processing space, for causing the processing liquid to flow-in in a direction opposite to a conveying direction of the photosensitive material; and a liquid flow-out structure, mounted to a position of the housing at another longitudinal direction end portion side of the processing space, for causing the processing liquid to flow-out in the direction opposite to the conveying direction of the photosensitive material.

4. The submerged processing device for a photosensitive material of claim 3, wherein the liquid flow-in structure comprises a check valve.

5. The submerged processing device for a photosensitive material of claim 3, wherein the liquid flow-out structure comprises a check valve.

6. A submerged processing device for a photosensitive material having a submerged processing chamber, comprising:

an entrance closing member provided in processing liquid at an upstream side, and closing a path at an upstream side of the submerged processing chamber along which path a photosensitive material passes, and permitting entry of the photosensitive material into the submerged processing chamber by elastically deforming;

an exit closing member provided in processing liquid at a downstream side, and closing a path at a downstream side of the submerged processing chamber along which path the photosensitive material passes, and permitting withdrawal of the photosensitive material from the submerged processing chamber by elastically deforming; and a storing portion formed between the entrance closing member and the exit closing member;

wherein a check valve, which makes processing liquid flow through in a direction opposite to a conveying direction of the photosensitive material, is provided at the storing portion.

7. The submerged processing device for a photosensitive material of claim 6, wherein the entrance closing member and the exit closing member are formed by blades.

8. The submerged processing device for a photosensitive material of claim 6, wherein the entrance closing member and the exit closing member are formed by rollers.

9. The submerged processing device for a photosensitive material of claim 6, wherein at least two check valves are provided.

10. The submerged processing device for a photosensitive material of claim 6, wherein the entrance closing member and the exit closing member are disposed in a vertical direction so as to be parallel to one another.

11. The submerged processing device for a photosensitive material of claim 7, wherein the entrance closing member and the exit closing member are disposed at predetermined angles with respect to a path of the submerged processing chamber along which path the photosensitive material passes.

12. A submerged processing device for a photosensitive material, comprising:

a processing tank main body storing a processing liquid;

at least two pairs of conveying rollers which are for nipping and conveying a photosensitive material, and which are disposed so as to be separated from one another by an interval in a conveying direction within the processing liquid in the processing tank main body; and rollers for sealing disposed between each of the conveying rollers and inner walls of the processing tank main body, and forming a processing chamber by partitioning an interior of the processing tank main body such that the processing liquid does not flow in or out of the processing chamber.

13. The submerged processing device for a photosensitive material of claim 12, wherein the conveying rollers and the rollers for sealing are disposed so as to be parallel to one another within the processing tank main body.

14. The submerged processing device for a photosensitive material of claim 12, wherein the interval is a distance which is shorter than a shortest length of the photosensitive material in the conveying direction.

15. A submerged processing device for a photosensitive material, comprising:

an entrance blade attached to a first main body member structuring a housing;

an exit blade attached to a second main body member structuring the housing; and a storing portion structured by the entrance blade, the exit blade and inner walls of the housing, and storing a processing liquid therein, wherein the entrance blade permits entry of the photosensitive material into the storing portion by elastically deforming, and the exit blade permits withdrawal of the photosensitive material from the storing portion by elastically deforming; and wherein a check valve, which makes processing liquid flow through in a direction opposite to a conveying direction of the photosensitive material, is provided at the storing portion.

16. The submerged processing device for a photosensitive material of claim 15, wherein the housing is structured by integrally engaging the first main body member and the second main body member.

17. The submerged processing device for a photosensitive material of claim 15, wherein the entrance blade and the exit blade are disposed in a vertical direction so as to be parallel to one another.

18. The submerged processing device for a photosensitive material of claim 15, wherein the entrance blade and the exit blade are disposed at predetermined angles with respect to a path of the storing portion along which path the photosensitive material passes.

* * * * *